US009566625B2

(12) United States Patent
Akashi et al.

(10) Patent No.: US 9,566,625 B2
(45) Date of Patent: Feb. 14, 2017

(54) APPARATUS FOR COOLING HOT-ROLLED STEEL SHEET

(71) Applicant: NIPPON STEEL & SUMITOMO METAL CORPORATION, Tokyo (JP)

(72) Inventors: Tooru Akashi, Tokyo (JP); Shingo Kuriyama, Tokyo (JP); Takeo Itoh, Tokyo (JP); Koji Noguchi, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 707 days.

(21) Appl. No.: 14/112,505

(22) PCT Filed: Dec. 6, 2012

(86) PCT No.: PCT/JP2012/081659

§ 371 (c)(1),
(2) Date: Oct. 17, 2013

(87) PCT Pub. No.: WO2014/087520

PCT Pub. Date: Jun. 12, 2014

(65) Prior Publication Data

US 2014/0053886 A1 Feb. 27, 2014

(51) Int. Cl.
*B21B 37/74* (2006.01)
*B21B 38/00* (2006.01)
(Continued)

(52) U.S. Cl.
CPC ..... *B21B 45/0218* (2013.01); *B21B 37/76* (2013.01); *B21B 1/24* (2013.01); *B21B 38/006* (2013.01); *B21B 38/02* (2013.01)

(58) Field of Classification Search
CPC ..... B21B 1/24; B21B 1/26; B21B 1/38; B21B 37/76; B21B 37/78; B21B 38/006; B21B 38/04; B21B 45/0215; B21B 45/0218
See application file for complete search history.

(56) References Cited

U.S. PATENT DOCUMENTS 4,047,985 A 9/1977 Greenberger
4,274,273 A 6/1981 Fapiano et al.
(Continued)

FOREIGN PATENT DOCUMENTS

CN 101780478 A 7/2010
CN 102166582 A 8/2011
(Continued)

OTHER PUBLICATIONS

Japanese Notice of Allowance for Japanese Application No. 2012-128595, dated Oct. 7, 2014, with an English translation.
(Continued)

*Primary Examiner* — Lois Zheng
(74) *Attorney, Agent, or Firm* — Birch, Stewart, Kolasch & Birch, LLP

(57) ABSTRACT

The apparatus for cooling a hot-rolled steel sheet of the invention includes a thermometer that measures the temperature of the hot-rolled steel sheet; a shape meter that measures a shape of the hot-rolled steel sheet; a top side cooling device that cools a top surface of the hot-rolled steel sheet in a cooling section; a bottom side cooling device that cools a bottom surface of the hot-rolled steel sheet in the cooling section; and a control device that controls at least one of an amount of heat dissipated from the top surface by cooling and an amount of heat dissipated from the bottom surface by cooling of the hot-rolled steel sheet in the cooling section by controlling the top side cooling device and the bottom side cooling device based on temperature measurement results and shape measurement results.

8 Claims, 14 Drawing Sheets

(51) Int. Cl.

| | |
|---|---|
| ***B21B 45/02*** | (2006.01) |
| ***B21B 37/76*** | (2006.01) |
| *B21B 1/26* | (2006.01) |
| *B21B 1/24* | (2006.01) |
| *B21B 38/02* | (2006.01) |

(56) References Cited

U.S. PATENT DOCUMENTS

| | | | |
|---|---|---|---|
| 4,726,213 | A | 2/1988 | Manchu |
| 5,259,229 | A | 11/1993 | Inagaki et al. |
| 6,615,633 | B1 | 9/2003 | Akashi et al. |
| 7,577,489 | B2 | 8/2009 | Fodor et al. |
| 2010/0132426 | A1 | 6/2010 | Baumgartel et al. |
| 2010/0218578 | A1 | 9/2010 | Tachibana |
| 2010/0219566 | A1 | 9/2010 | Shimoi et al. |
| 2012/0151981 | A1 | 6/2012 | Yoshii et al. |
| 2012/0216924 | A1 | 8/2012 | Ota |
| 2012/0318414 | A1 | 12/2012 | Tachibana et al. |
| 2012/0318478 | A1 | 12/2012 | Weinzierl |
| 2014/0053886 | A1 | 2/2014 | Akashi et al. |
| 2014/0060139 | A1 | 3/2014 | Akashi et al. |

FOREIGN PATENT DOCUMENTS

| | | | |
|---|---|---|---|
| CN | 102481610 | A | 5/2012 |
| CN | 102596440 | A | 7/2012 |
| CN | 102781598 | A | 11/2012 |
| EP | 2070608 | A1 | 6/2009 |
| JP | 2-75409 | A | 3/1990 |
| JP | 2-179819 | A | 7/1990 |
| JP | 2-179825 | A | 7/1990 |
| JP | 2-179827 | A | 7/1990 |
| JP | 3-18416 | A | 1/1991 |
| JP | 5-337505 | A | 12/1993 |
| JP | 6-228651 | A | 8/1994 |
| JP | 6-228652 | A | 8/1994 |
| JP | 6-228653 | A | 8/1994 |
| JP | 6-328117 | A | 11/1994 |
| JP | 7-63750 | B2 | 7/1995 |
| JP | 7-214133 | A | 8/1995 |
| JP | 10-166023 | A | 6/1998 |
| JP | 10-263696 | A | 10/1998 |
| JP | 11-347629 | A | 12/1999 |
| JP | 2000-1719 | A | 1/2000 |
| JP | 2000-317513 | A | 11/2000 |
| JP | 2002-45908 | A | 2/2002 |
| JP | 2003-48003 | A | 2/2003 |
| JP | 2005-66614 | A | 3/2005 |
| JP | 2005-74463 | A | 3/2005 |
| JP | 3657750 | B2 | 6/2005 |
| JP | 2005-271052 | A | 10/2005 |
| JP | 2006-272441 | A | 10/2006 |
| JP | 2006-281271 | A | 10/2006 |
| JP | 2007-216246 | A | 8/2007 |
| JP | 4029871 | B2 | 1/2008 |
| JP | 2009-208086 | A | 9/2009 |
| JP | 2010-105027 | A | 5/2010 |
| JP | 2011-73054 | A | 4/2011 |
| TW | I315683 | B | 10/2009 |
| WO | WO 2009/011070 | A1 | 1/2009 |
| WO | WO 2011/104103 | A2 | 9/2011 |

OTHER PUBLICATIONS

Korean Office Action for Korean Application No. 10-2013-7019174, dated Oct. 28, 2014, with an English translation.

Japanese Office Action for Japanese Application No. 2011-127154, issued Dec. 3, 2013, with an translation.

Japanese Office Action for Japanese Application No. 2012-128595, issued Jan. 6, 2014, with an English translation.

Japanese Office Action for Japanese Application No. 2012-151025, issued Jan. 6, 2014, with an English translation.

Extended European Search Report, dated Jun. 2, 2016, for European Application No. 12873885.3.

Korean Notice of Allowance dated Apr. 3, 2015, for Korean Application No. 10-2013-7019174 with the English translation.

Sperle et al., "High Strength and Ultra High Strength Steels for Weight Reduction in Structural and Safety Related Applications", 29th Int. Symposium on Automotive Technology & Automation (ISATA), Jun. 1996, p. 1-10.

U.S. Office Action dated Mar. 23, 2015, for U.S. Appl. No. 14/111,959.

U.S. Office Action dated Mar. 23, 2015, for U.S. Appl. No. 14/111,457.

Chinese Office Action and Search Report for Chinese Application No. 201280007157.6, dated Feb. 3, 2015, with an English translation of the Chinese Search Report only.

Taiwanese Notice of Allowance for Taiwanese Application No. 101146085, dated Dec. 30, 2014, with an English translation.

Chinese Office Action and Search Report, Issued Feb. 27, 2015, for Chinese Application No. 201280005604.4, along with an English translation of the Chinese Search Report.

Chinese Office Action and Search Report, issued Mar. 17, 2015, for Chinese Application No. 201280010631.0, along with an English translation of the Chinese Search Report.

Taiwanese Office Action and Search Report, dated Jun. 9, 2015, for Application No. 101146092 with a partial translation of the Search Report.

International Search Report, mailed Jan. 22, 2013, issued in PCT/JP2012/081634.

International Search Report, mailed Jan. 22, 2013, issued in PCT/JP2012/081659.

International Search Report, mailed Jan. 22, 2013, issued in PCT/JP2012/081670.

Office Action issued Apr. 23, 2013 in Japanese Patent Application 2012-128595.

Written Opinion of the International Searching Authority, mailed Jan. 22, 2013, issued in PCT/JP2012/081659.

APPARATUS FOR COOLING HOT-ROLLED STEEL SHEET

TECHNICAL FIELD

The present invention relates to an apparatus for cooling a hot-rolled steel sheet which cools a hot-rolled steel sheet hot-rolled using a finishing mill.

BACKGROUND ART

For example, a hot-rolled steel sheet used in cars, industrial machines and the like is generally manufactured through a rough-rolling process and a finish-rolling process. FIG. 18 is a view schematically illustrating a method for manufacturing a hot-rolled steel sheet of the related art. In the process for manufacturing a hot-rolled steel sheet, first, a slab S obtained by continuously casting molten steel having an adjusted predetermined composition is rolled using a roughing mill 201, and then, furthermore, hot-rolled using a finishing mill 203 constituted by a plurality of rolling stands 202*a* to 202*d*, thereby forming a hot-rolled steel sheet H having a predetermined thickness. In addition, the hot-rolled steel sheet H is cooled using cooling water supplied from a cooling apparatus 211, and then coiled into a coil shape using a coiling apparatus 212.

The cooling apparatus 211 is generally a facility for carrying out so-called laminar cooling on the hot-rolled steel sheet H transported from the finishing mill 203. The cooling apparatus 211 sprays the cooling water on the top surface of the hot-rolled steel sheet H moving on a run-out table from the top in the vertical direction in a water jet form through a cooling nozzle, and, simultaneously, sprays the cooling water on the bottom surface of the hot-rolled steel sheet H through a pipe laminar in a water jet form, thereby cooling the hot-rolled steel sheet H.

In addition, for example, Patent Document 1 discloses a technique of the related art which reduces the difference in surface temperature between the top and bottom surfaces of a thick steel sheet, thereby preventing the shape of the steel sheet from becoming defective. According to the technique disclosed in Patent Document 1, the water volume ratio of cooling water supplied to the top surface and the bottom surface of the steel sheet is adjusted based on the difference in surface temperature obtained by simultaneously measuring the surface temperatures of the top surface and the bottom surface of the steel sheet using a thermometer when the steel sheet is cooled using a cooling apparatus.

In addition, for example, Patent Document 2 discloses a technique that cools a rolled material between two adjacent stands in a finishing mill using a sprayer, thereby beginning and completing the $\gamma$-$\alpha$ transformation of the rolled material so as to prevent sheet-threading performance between the stands from deteriorating.

In addition, for example, Patent Document 3 discloses a technique that measures the steepness at the tip of a steel sheet using a steepness meter installed on the exit side of a mill, and prevents the steel sheet from being perforated by adjusting the flow rate of cooling water to be different in the width direction based on the measured steepness.

Furthermore, for example, Patent Document 4 discloses a technique that aims to solve a wave-shaped sheet thickness distribution in the sheet width direction of a hot-rolled steel sheet and to make uniform the sheet thickness in the sheet width direction, and controls the difference between the maximum heat transmissibility and the minimum heat transmissibility in the sheet width direction of the hot-rolled steel sheet to be in a range of predetermined values.

Here, there are cases in which the hot-rolled steel sheet H manufactured using the manufacturing method illustrated in FIG. 18 forms a wave shape in the rolling direction (the arrow direction in FIG. 19) on transportation rolls 220 in the run-out table (hereinafter sometimes referred to as "ROT") in the cooling apparatus 211 as illustrated in FIG. 19. In this case, the top surface and the bottom surface of the hot-rolled steel sheet H are not uniformly cooled. That is, there was a problem in that, due to cooling deviation caused by the wave shape of the hot-rolled steel sheet H, it became impossible to uniformly cool the steel sheet in the rolling direction.

Therefore, for example, Patent Document 5 discloses a technique that, in a steel sheet formed into a wave shape in the rolling direction, makes uniform the cooling capabilities of top portion cooling and bottom portion cooling so as to minimize the influence of the distance between soaked water on the top portion of the steel sheet and a table roller at the bottom portion in order to uniformly cool the steel sheet.

PRIOR ART DOCUMENT

Patent Document

[Patent Document 1] Japanese Unexamined Patent Application, First Publication No. 2005-74463
[Patent Document 2] Japanese Unexamined Patent Application, First Publication No. H05-337505
[Patent Document 3] Japanese Unexamined Patent Application, First Publication No. 2005-271052
[Patent Document 4] Japanese Unexamined Patent Application, First Publication No. 2003-48003
[Patent Document 5] Japanese Unexamined Patent Application, First Publication No. H06-328117

SUMMARY OF THE INVENTION

Problem that the Invention is to Solve

However, in the cooling method of Patent Document 1, a case of a hot-rolled steel sheet having a wave shape in the rolling direction is not taken into consideration. In the hot-rolled steel sheet H having a wave shape described above, there are cases in which the bottom portion of the wave shape locally comes into contact with the transportation rolls 220 as illustrated in FIG. 19. In addition, there are cases in which the hot-rolled steel sheet H locally comes into contact with aprons (not illustrated in FIG. 19) provided as supports in order to prevent the hot-rolled steel sheet H from dropping between the transportation rolls 220 at the bottom portion of the wave shape. In the wave-shaped hot-rolled steel sheet H, the portions that locally come into contact with the transportation rolls 220 or the aprons become more easily cooled than other portions due to heat dissipation by contact. Therefore, there was a problem in that the hot-rolled steel sheet H was ununiformly cooled. That is, in Patent Document 1, the fact that the wave shape of the hot-rolled steel sheet causes the hot-rolled steel sheet to locally come into contact with the transportation rolls or the aprons and the contact portions becomes easily cooled due to heat dissipation by contact is not taken into consideration. Therefore, there are cases in which it is impossible to uniformly cool a hot-rolled steel sheet having a wave shape formed as described above.

In addition, the technique described in Patent Document 2 is to make (soft) ultra low carbon steel having a relatively low hardness undergo γ-α transformation between stands in a finishing mill, and does not aim at uniform cooling. In addition, the invention of Patent Document 2 does not relate to cooling in a case in which a rolled material has a wave shape in the rolling direction or a rolled material is a steel material that is so-called high tensile strength steel having a tensile strength (TS) of 800 MPa or more, and therefore there is a concern that uniform cooling may not be possible in a case in which a rolled material is a hot-rolled steel sheet having a wave shape or a steel material having a relatively high hardness.

In addition, in the cooling method of Patent Document 3, the steepness of the steel sheet in the width direction is measured, and the flow rate of cooling water is adjusted in portions having a high steepness. However, when the flow rate of cooling water in the sheet width direction of the steel sheet is changed, it becomes difficult to make uniform the temperature of the steel sheet in the sheet width direction. Furthermore, Patent Document 3 also does not take a hot-rolled steel sheet having a wave shape in the rolling direction into consideration, and there are cases in which it is not possible to uniformly cool a hot-rolled steel sheet as described above.

In addition, the cooling of Patent Document 4 is the cooling of a hot-rolled steel sheet immediately before roll bites in the finishing mill, and therefore it is not possible to apply the cooling to a hot-rolled steel sheet which has undergone finish-rolling so as to have a predetermined thickness. Furthermore, Patent Document 4 also does not take a hot-rolled steel sheet having a wave shape in the rolling direction into consideration, and there are cases in which it is not possible to uniformly cool a hot-rolled steel sheet in the rolling direction as described above.

In addition, in the cooling method of Patent Document 5, the cooling capability of the top portion cooling includes not only cooling by the cooling water supplied to the steel sheet from a top portion water supply nozzle but also cooling by the soaked water in the top portion of the steel sheet. Since the soaked water is influenced by the steepness of the wave shape formed in the steel sheet or the sheet-threading speed of the steel sheet, strictly, it is not possible to specify the cooling capability of the steel sheet due to the soaked water. Thus, it is difficult to accurately control the cooling capability of the top portion cooling. Therefore, it is also difficult to make the cooling capabilities of the top portion cooling and the bottom portion cooling equivalence. Furthermore, the patent document describes an example of a method for determining the cooling capabilities when the cooling capabilities of the top portion cooling and the bottom portion cooling are made uniform, but does not disclose ordinary determination methods. Therefore, in the cooling method of Patent Document 5, there are cases in which it is not possible to uniformly cool a hot-rolled steel sheet.

The present invention has been made in consideration of the above problems, and an object of the present invention is to uniformly cool a hot-rolled steel sheet hot-rolled using a finishing mill.

Means for Solving the Problems

The present invention employs the following means for solving the problems and achieving the relevant object.

That is, (1) According to an aspect of the present invention, an apparatus for cooling a hot-rolled steel sheet is provided which cools a hot-rolled steel sheet hot-rolled using a finishing mill in a cooling section provided on a sheet-threading path including a thermometer that measures the temperature of the hot-rolled steel sheet on a downstream side of the cooling section; a shape meter that measures a shape of the hot-rolled steel sheet on the downstream side of the cooling section; a top side cooling device that cools a top surface of the hot-rolled steel sheet in the cooling section; a bottom side cooling device that cools a bottom surface of the hot-rolled steel sheet in the cooling section; and a control device that controls at least one of an amount of heat dissipated from the top surface by cooling and an amount of heat dissipated from the bottom surface by cooling of the hot-rolled steel sheet in the cooling section by controlling the top side cooling device and the bottom side cooling device based on temperature measurement results of the hot-rolled steel sheet obtained from the thermometer and the shape measurement results of the hot-rolled steel sheet obtained from the shape meter, in which the control device includes an average temperature computation unit that computes a chronological average value of the temperature of the hot-rolled steel sheet on the downstream side of the cooling section as an average temperature based on the temperature measurement results; a changing speed computation unit that computes a changing speed of the hot-rolled steel sheet on the downstream side of the cooling section based on the shape measurement results; a control direction-determining unit that, when upward in a vertical direction of the hot-rolled steel sheet is set as positive, in an area with a positive changing speed, in a case in which the temperature of the hot-rolled steel sheet is lower than an average temperature of a range of one or more cycles of a wave shape of the hot-rolled steel sheet, determines at least one of a direction in which the amount of heat dissipated from the top surface by cooling decreases and a direction in which the amount of heat dissipated from the bottom surface by cooling increases as a control direction, and, in a case in which the temperature of the hot-rolled steel sheet is higher than the average temperature, determines at least one of a direction in which the amount of heat dissipated from the top surface by cooling increases and a direction in which the amount of heat dissipated from the bottom surface by cooling decreases as the control direction, in an area with a negative changing speed, in a case in which the temperature of the hot-rolled steel sheet is lower than the average temperature, determines at least one of a direction in which the amount of heat dissipated from the top surface by cooling increases and a direction in which the amount of heat dissipated from the bottom surface by cooling decreases as the control direction, and, in a case in which the temperature of the hot-rolled steel sheet is higher than the average temperature, determines at least one of a direction in which the amount of heat dissipated from the top surface by cooling decreases and a direction in which the amount of heat dissipated from the bottom surface by cooling increases as the control direction; and a total amount of heat dissipated by cooling-adjusting unit that adjusts a total value of the amount of heat dissipated from the top surface by cooling and the amount of heat dissipated from the bottom surface by cooling of the hot-rolled steel sheet in the cooling section based on the control directions determined using the control direction-determining unit.

(2) In the apparatus for cooling a hot-rolled steel sheet according to the above (1), a location deviation between a temperature measurement place of the thermometer and a shape measurement place of the shape meter in the hot-rolled steel sheet is preferably 50 mm or less.

(3) In the apparatus for cooling a hot-rolled steel sheet according to the above (1) or (2), a sheet-threading speed of the hot-rolled steel sheet in the cooling section is preferably set in a range of 550 m/min to a mechanical limit speed.

(4) In the apparatus for cooling a hot-rolled steel sheet according to the above (3), a tensile strength of the hot-rolled steel sheet is preferably 800 MPa or more.

(5) In the apparatus for cooling a hot-rolled steel sheet according to the above (3), the finishing mill is preferably constituted by a plurality of rolling stands, and a supplementary cooling device that carries out supplementary cooling of the hot-rolled steel sheet is preferably further provided between the adjacent rolling stands.

Effect of the Invention

According to the above aspect of the present invention, when the phase of the temperature of a hot-rolled steel sheet is detected, and compared with a wave shape of the hot-rolled steel sheet, it is possible to adjust the top side cooling capability and the bottom side cooling capability, and it is possible to adjust the amount of heat dissipated from the top surface by cooling and the amount of heat dissipated from the bottom surface by cooling of the hot-rolled steel sheet. Therefore, afterwards, when the hot-rolled steel sheet is cooled using the adjusted cooling capabilities, it is possible to uniformly cool the hot-rolled steel sheet.

EMBODIMENT OF THE INVENTION

Hereinafter, as an embodiment of the present invention, an apparatus for cooling a hot-rolled steel sheet that cools a hot-rolled steel sheet used in, for example, cars and industrial machines will be described with reference to the accompanying drawings.

Figure 1:
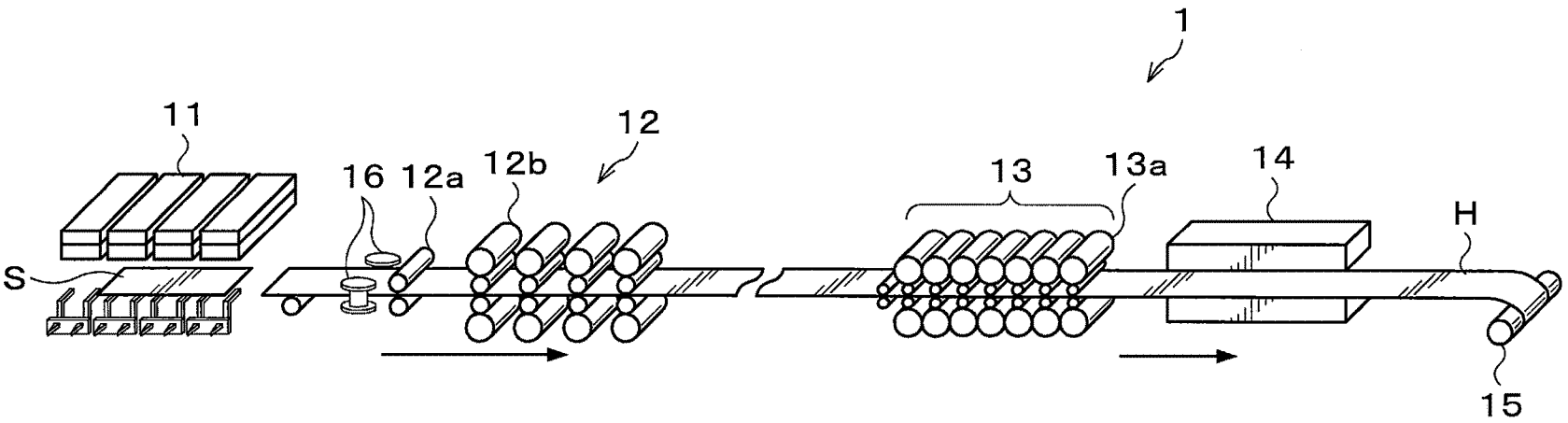
FIG. 1 is an explanatory view illustrating a hot rolling facility 1 having an apparatus for cooling a hot-rolled steel sheet in an embodiment of the present invention.

FIG. 1 schematically illustrates an example of a hot rolling facility 1 having the apparatus for cooling a hot-rolled steel sheet in the present embodiment. The hot rolling facility 1 is a facility which aims to sandwich the top and bottom of a heated slab S using rolls, continuously roll the slab to make the slab as thin as a minimum of 1 mm, and coil the slab.

The hot rolling facility 1 has a heating furnace 11 for heating the slab S, a width-direction mill 16 that rolls the slab S heated in the heating furnace 11 in a width direction, a roughing mill 12 that rolls the slab S rolled in the width direction from the vertical direction so as to produce a rough bar, a finishing mill 13 that further continuously hot-finishing-rolls the rough bar to a predetermined thickness, a cooling apparatus 14 that cools the hot-rolled steel sheet H hot-finishing-rolled using the finishing mill 13 using cooling water, and a coiling apparatus 15 that coils the hot-rolled steel sheet H cooled using the cooling apparatus 14 into a coil shape.

The heating furnace 11 is provided with a side burner, an axial burner and a roof burner that heat the slab S brought from the outside through a charging hole by blowing flame. The slab S brought into the heating furnace 11 is sequentially heated in respective heating areas formed in respective zones, and, furthermore, a heat-retention treatment for enabling transportation at an optimal temperature is carried out by uniformly heating the slab S using the roof burner in a soaking area formed in a final zone. When a heating treatment in the heating furnace 11 completely ends, the slab S is transported to the outside of the heating furnace 11, and moved into a rolling process by the roughing mill 12.

The roughing mill 12 passes the transported slab S through gaps between columnar rotary rolls provided across a plurality of stands. For example, the roughing mill 12 hot-rolls the slab S only using work rolls 12*a* provided at the top and bottom of a first stand so as to form a rough bar. Next, the rough bar which has passed through the work rolls 12*a* is further continuously rolled using a plurality of fourfold mills 12*b* constituted by a work roll and a back-up roll. As a result, when the rough rolling process ends, the rough bar is rolled into a thickness of approximately 30 mm to 60 mm, and transported to the finishing mill 13.

The finishing mill 13 finishing-rolls the rough bar transported from the roughing mill 12 until the thickness becomes approximately several millimeters. The finishing mill 13 passes the rough bar through gaps between top and bottom finish rolling rolls 13*a* linearly arranged across 6 to 7 stands so as to gradually reduce the rough bar. The hot-rolled steel sheet H finishing-rolled using the finishing mill 13 is transported to the cooling apparatus 14 using the transportation rolls 32 described below.

Figure 2:
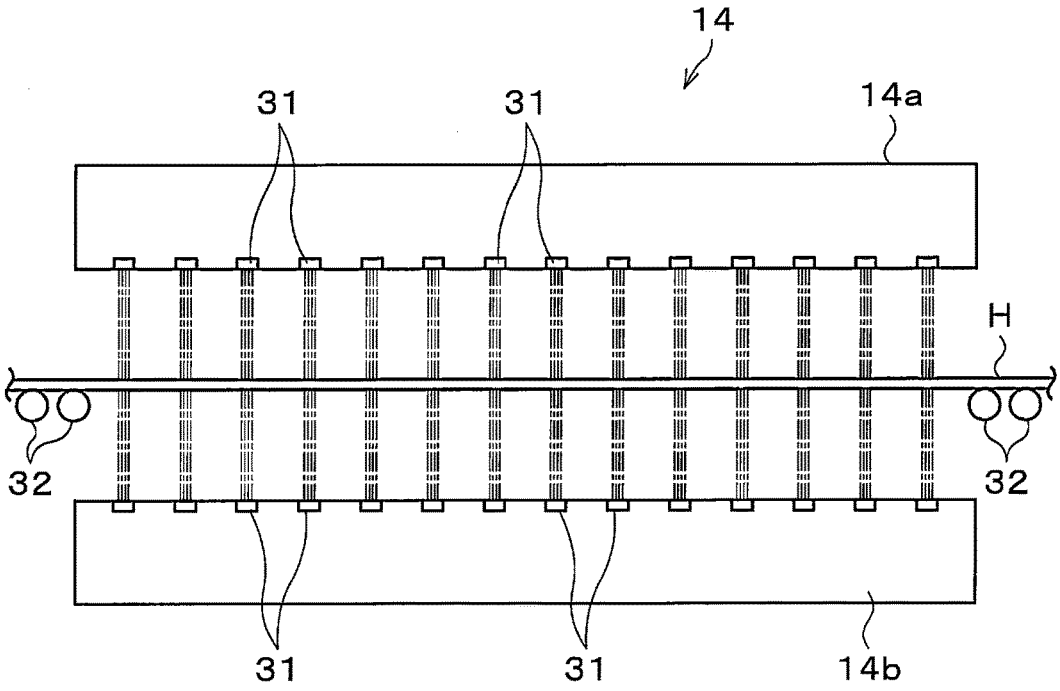
FIG. 2 is an explanatory view illustrating an outline of a configuration of a cooling apparatus 14 in the present embodiment.

The cooling apparatus 14 is a facility for carrying out so-called laminar cooling on the hot-rolled steel sheet H transported from the finishing mill 13. As illustrated in FIG. 2, the cooling apparatus 14 has a top side cooling device 14*a* that sprays cooling water from cooling holes 31 on the top side to the top surface of the hot-rolled steel sheet H moving on the transportation rolls 32 in a run-out table, and a bottom side cooling device 14*b* that sprays cooling water from cooling holes 31 on the bottom side to the bottom surface of the hot-rolled steel sheet H. A plurality of the cooling holes 31 is provided in the top side cooling device 14*a* and the bottom side cooling device 14*b* respectively.

In addition, a cooling header (not illustrated) is connected to the cooling hole 31. The number of the cooling holes 31 determines the cooling capabilities of the top side cooling device 14*a* and the bottom side cooling device 14*b*. Meanwhile, the cooling apparatus 14 may be constituted by at least one of top and bottom split laminar, pipe laminar, spray cooling and the like. In addition, a section in which the hot-rolled steel sheet H is cooled using the cooling apparatus 14 corresponds to a cooling section in the present invention.

Figure 3:
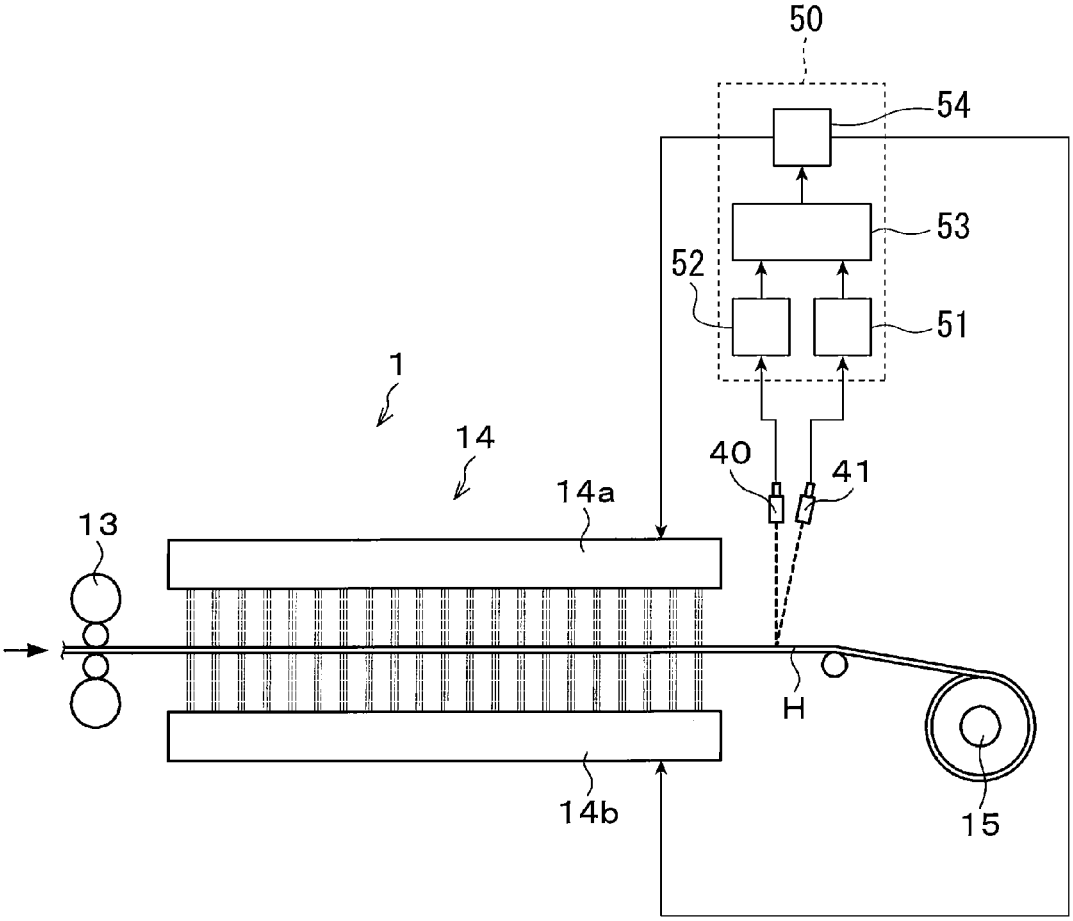
FIG. 3 is an explanatory view illustrating an outline of a configuration in a vicinity of the cooling apparatus 14 in the hot rolling facility 1.

In addition, on the downstream side of the cooling section (that is, the cooling apparatus 14), a thermometer 40 that measures the temperature of a measurement location set in the rolling direction of the hot-rolled steel sheet H and a shape meter 41 that measures the wave shape of the hot-rolled steel sheet H at the same measurement location as the thermometer 40 are disposed as illustrated in FIG. 3.

The thermometer 40 and the shape meter 41 are electrically connected to a control device 50 through cables and the like. In addition, the control device 50 is electrically connected to the top side cooling device 14*a* and the bottom side cooling device 14*b* through cables and the like.

The thermometer 40 outputs the temperature measurement results of the hot-rolled steel sheet H to the control device 50. The shape meter 41 outputs the shape measurement results of the hot-rolled steel sheet H to the control device 50.

The control device 50 controls at least one of the amount of heat dissipated from the top surface by cooling and the amount of heat dissipated from the bottom surface by cooling of the hot-rolled steel sheet H in the cooling section by controlling the top side cooling device 14*a* and the bottom side cooling device 14*b* based on the temperature measurement results obtained from the thermometer 40 and the shape measurement results obtained from the shape meter 41.

The control device 50 has an average temperature computation unit 51, a changing speed computation unit 52, a control direction-determining unit 53 and a total amount of heat dissipated by cooling-adjusting unit 54 as functions realized by running of programs. The functions of the respective functional units will be described.

The coiling apparatus 15 coils the hot-rolled steel sheet H cooled using the cooling apparatus 14 at a predetermined coiling temperature as illustrated in FIG. 1. The hot-rolled steel sheet H coiled into a coil shape using the coiling apparatus 15 is transported to the outside of the hot rolling facility 1.

Meanwhile, in the hot rolling facility 1 constituted as described above, the top side cooling device 14*a*, the bottom side cooling device 14*b*, the thermometer 40, the shape meter 41 and the control device 50 constitute the apparatus for cooling a hot-rolled steel sheet in the present embodiment.

Next, a method for cooling the hot-rolled steel sheet H, which is realized using the hot rolling facility 1 constituted as described above, will be described.

Figure 19:
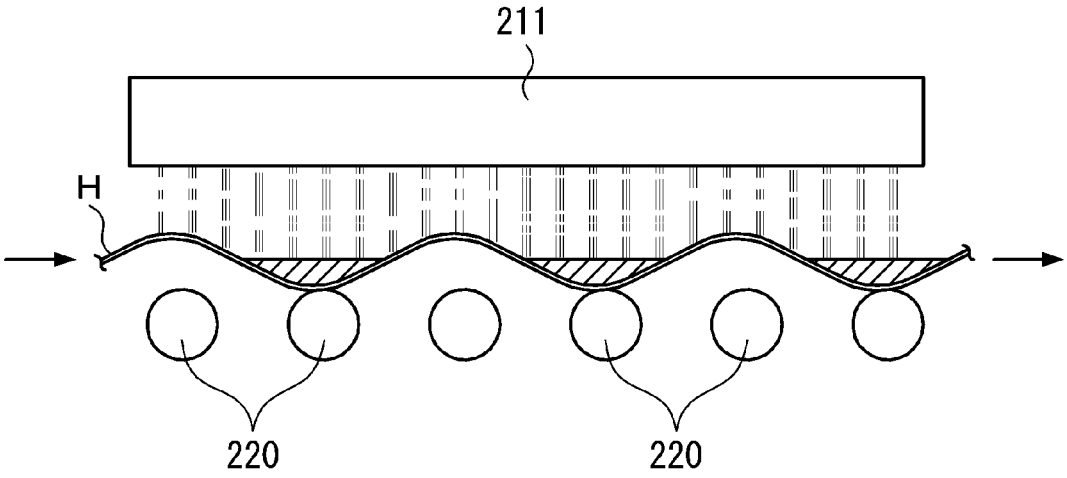
FIG. 19 is an explanatory view illustrating a method for cooling the hot-rolled steel sheet H of the related art.

Meanwhile, in the following description, a wave shape having a surface height (wave height) changing in the rolling direction is formed in the hot-rolled steel sheet H hot-rolled using the finishing mill 13 as illustrated in FIG. 19. In addition, in the following description, the influence of soaked water remaining on the hot-rolled steel sheet H will be ignored when cooling the hot-rolled steel sheet H. Actually, as a result of investigation by the inventors, it has been found that the soaked water remaining on the hot-rolled steel sheet H has little influence.

First, before cooling the hot-rolled steel sheet H in the cooling apparatus 14, the cooling capability (top side cooling capability) of the top side cooling device 14*a* and the cooling capability (bottom side cooling capability) of the bottom side cooling device 14*b* are adjusted respectively in advance. The top side cooling capability and the bottom side cooling capability are adjusted using the heat transfer coefficient of the top surface of the hot-rolled steel sheet H, which is cooled using the top side cooling device 14*a*, and the heat transfer coefficient of the bottom surface of the hot-rolled steel sheet H, which is cooled using the bottom side cooling device 14*b*.

Here, a method for computing the heat transfer coefficients of the top surface and bottom surface of the hot-rolled steel sheet H will be described. The heat transfer coefficient refers to a value obtained by dividing the amount of heat dissipated from a unit area by cooling (heat energy) per unit time by the temperature difference between an article to which heat is transferred and a heat medium (heat transfer coefficient=amount of heat dissipated by cooling/temperature difference). The temperature difference herein refers to the difference between the temperature of the hot-rolled steel sheet H, which is measured using a thermometer on an entry side of the cooling apparatus 14, and the temperature of cooling water used in the cooling apparatus 14.

In addition, the amount of heat dissipated by cooling refers to a value obtained by respectively multiplying the temperature difference, specific heat and mass of the hot-rolled steel sheet H (amount of heat dissipated by cooling=temperature difference×specific heat×mass). That is, the amount of heat dissipated by cooling is an amount of heat dissipated by cooling of the hot-rolled steel sheet H in the cooling apparatus 14, and a value obtained by multiplying the difference between the temperatures of the hot-rolled steel sheet H respectively measured using the entry-side thermometer and an exit-side thermometer in the cooling apparatus 14, the specific heat of the hot-rolled steel sheet H and the mass of the hot-rolled steel sheet H cooled using the cooling apparatus 14 respectively.

As described above, the computed heat transfer coefficient of the hot-rolled steel sheet H is classified into the heat transfer coefficient of the top surface and the heat transfer coefficient of the bottom surface of the hot-rolled steel sheet H. The heat transfer coefficients of the top surface and the bottom surface are computed using a ratio that is obtained in advance, for example, in the following manner.

That is, the heat transfer coefficient of the hot-rolled steel sheet H in a case in which the hot-rolled steel sheet H is cooled only using the top side cooling device 14*a* and the heat transfer coefficient of the hot-rolled steel sheet H in a case in which the hot-rolled steel sheet H is cooled only using the bottom side cooling device 14*b* are measured.

At this time, the amount of cooling water from the top side cooling device 14*a* and the amount of cooling water from the bottom side cooling device 14*b* are set to be equal. The inverse number of the ratio between the measured heat transfer coefficient in a case in which the top side cooling device 14*a* is used and the heat transfer coefficient in a case in which the bottom side cooling device 14*b* is used becomes a top and bottom ratio of the amount of cooling water from the top side cooling device 14*a* to the amount of cooling water from the bottom side cooling device 14*b* in a case in which a top and bottom heat transfer coefficient ratio is set to "1".

In addition, the above-mentioned ratio of the heat transfer coefficients of the top surface and the bottom surface of the hot-rolled steel sheet H is computed by multiplying the amount of cooling water from the top side cooling device 14*a* or the amount of cooling water from the bottom side cooling device 14*b* when cooling the hot-rolled steel sheet H by the top and bottom ratio of the amounts of cooling water obtained in the above manner.

In addition, in the above description, the heat transfer coefficients of the hot-rolled steel sheet H cooled only using the top side cooling device 14*a* and only using the bottom side cooling device 14*b* are used, but the heat transfer coefficient of the hot-rolled steel sheet H cooled using both the top side cooling device 14*a* and the bottom side cooling device 14*b* may be used. That is, the heat transfer coefficients of the hot-rolled steel sheet H in a case in which the amounts of cooling water of the top side cooling device 14*a* and the bottom side cooling device 14*b* are changed are measured, and the ratio of the heat transfer coefficients of the top surface and the bottom surface of the hot-rolled steel sheet H may be computed using the ratio of the heat transfer coefficients.

As described above, the heat transfer coefficients of the hot-rolled steel sheet H are computed, and the heat transfer coefficients of the top surface and the bottom surface of the hot-rolled steel sheet H are computed based on the above ratio of the heat transfer coefficients of the top surface and the bottom surface of the hot-rolled steel sheet H (top and bottom heat transfer coefficient ratio).

Here, as a result of thorough studies regarding the adjustment of the cooling capabilities of the top side cooling device 14*a* and the bottom side cooling device 14*b* (control of the amount of heat dissipated from the top surface by cooling and the amount of heat dissipated from the bottom surface by cooling of the hot-rolled steel sheet H) in order to uniformly cool the hot-rolled steel sheet H, the inventors further obtained the following findings.

As a result of repeating thorough studies regarding the characteristics of the temperature standard deviation generated by cooling in a state in which a wave shape of the hot-rolled steel sheet H is generated, the inventors clarified the following fact.

The temperature and shape of the hot-rolled steel sheet H in the process of sheet-threading are measured at measurement locations set in the rolling direction of the hot-rolled steel sheet H (hereinafter, the measurement locations will be sometimes referred to as fixed points) using the thermometer 40 and the shape meter 41 at certain time intervals (sampling intervals), and the chronological data of the temperature measurement results and the shape measurement results are obtained.

Meanwhile, the temperature measurement area using the thermometer 40 includes all the area of the hot-rolled steel sheet H in the width direction. In addition, the shape refers to the steepness obtained through the line integration of the heights or changing components of pitches of the wave using the amount of movement of the hot-rolled steel sheet H in the sheet-threading direction as the amount of change of the hot-rolled steel sheet H in the height direction observed in measurement at the fixed point. In addition, at the same time, the amount of change per unit time, that is, changing speed is also obtained. Furthermore, similarly to the temperature measurement area, the shape measurement area includes all the areas of the hot-rolled steel sheet H in the width direction. In addition, when the sampling times of the respective measurement results are multiplied by the sheet-threading speed (transportation speed) of the hot-rolled steel sheet H, it is possible to compute the locations of the hot-rolled steel sheet H in the rolling direction at which the respective measurement results are obtained. That is, when the times at which the chronological data of the respective measurement results are sampled are multiplied by the sheet-threading speed, it becomes possible to link the chronological data of the respective measurement results to the locations in the rolling direction.

First, the total value of the amount of heat dissipated from the top surface by cooling and the amount of heat dissipated from the bottom surface by cooling of the hot-rolled steel sheet H is adjusted using the chronological data. Specifically, the total value of the amount of heat dissipated from the top surface by cooling and the amount of heat dissipated from the bottom surface by cooling of the hot-rolled steel sheet H is adjusted so that the chronological average value of the temperatures measured using the thermometer 40 matches a predetermined target value.

In addition, when adjusting the total value of the amount of heat dissipated from the top surface by cooling and the amount of heat dissipated from the bottom surface by cooling, the on-off control of cooling headers connected to the cooling apparatus 14 may be carried out on a theoretical value obtained in advance using an experimental theoretical formula represented by, for example, Mitsuzuka's formula based on a learned value set to correct the error with an actual operation achievement. Alternatively, the on-off of the cooling headers may be feedback-controlled or feedforward-controlled based on the temperature actually measured using the thermometer 40.

Figure 4:
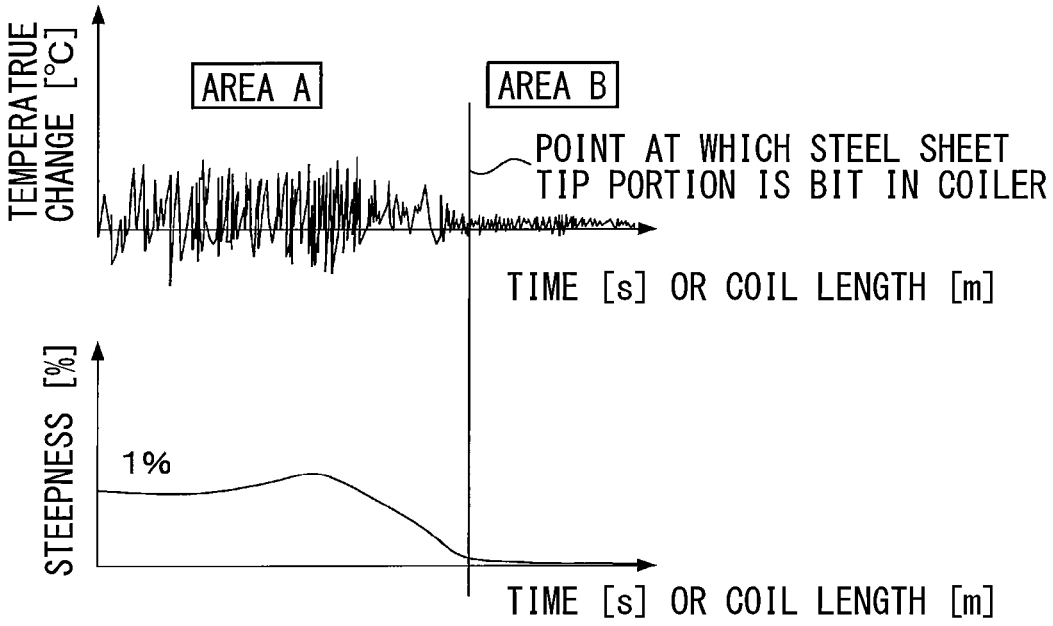
FIG. 4 is a graph illustrating a relationship between temperature change and steepness of the hot-rolled steel sheet H during cooling in a ROT of a typical strip in an ordinary operation, in which the top graph indicates the temperature change with respect to a distance from a coil tip or a time at which a coil passes a fixed point, and the bottom graph indicates the steepness with respect to the distance from the coil tip or the time at which the coil passes the fixed point.

Next, the cooling control of the ROT of the related art will be described using data obtained from the above-described thermometer 40 and a shape meter 41. FIG. 4 illustrates the relationship between the temperature change and steepness of the hot-rolled steel sheet H during cooling in the ROT of a typical strip in an ordinary operation. The top and bottom heat transfer coefficient ratio of the hot-rolled steel sheet H in FIG. 4 is 1.2:1, and the top side cooling capability is superior to the bottom side cooling capability. The top graph in FIG. 4 indicates the temperature change with respect to the distance from a coil tip or a time at which a coil passes the fixed point, and the bottom graph in FIG. 4 indicates the steepness with respect to the distance from the coil tip or the time at which the coil passes the fixed point.

The area A in FIG. 4 is an area before the strip tip portion illustrated in FIG. 3 is bit in a coiler of the coiling apparatus 15 (since there is no tension, the shape is defective in this area). The area B in FIG. 4 is an area after the strip tip portion is bit in the coiler (the area in which the wave shape is changed to be flat by the influence of unit tension). There is a demand for improving a large temperature change (that is, the temperature standard deviation) occurring in the area in which the shape of the hot-rolled steel sheet H is not flat.

Therefore, the inventors carried out thorough tests for the purpose of controlling the increase in the temperature standard deviation in ROT, and, consequently, obtained the following findings.

Figure 5:
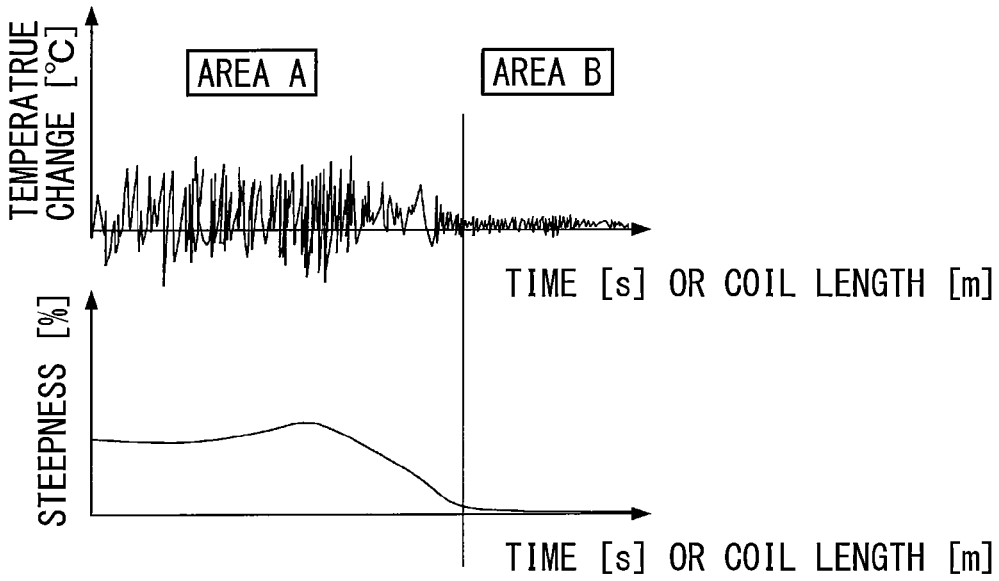
FIG. 5 is a graph illustrating the relationship between the temperature change and steepness of the hot-rolled steel sheet H during cooling in a ROT of the typical strip in the ordinary operation.

Similarly to FIG. 4, FIG. 5 illustrates the temperature-changing component with respect to the steepness of the same shape during cooling in the ROT of the typical strip in the ordinary operation. The temperature-change component is a residual error obtained by subtracting the chronological average of the temperature from the actual steel sheet temperature (hereinafter sometimes referred to as "average temperature"). For example, the average temperature may be the average of the temperature of a range that is a cycle or more of the wave shape of the hot-rolled steel sheet H.

Meanwhile, the average temperature is, in principle, the average of the temperature range of the unit cycle. In addition, it is confirmed from operation data that there is no large difference between the average temperature of a range of a cycle and the average temperature of a range of two or more cycles.

Therefore, the average temperature simply needs to be computed from a range of at least a cycle of the wave shape. The upper limit of the range of the wave shape of the hot-rolled steel sheet H is not particularly limited; however, a sufficiently accurate average temperature can be obtained when the range is preferably set to 5 cycles. In addition, even when the average temperature is computed not from a range of the unit cycle but from a range of 2 to 5 cycles, a permissible average temperature can be obtained.

Here, when upward in the vertical direction (the direction that is perpendicular to the top and bottom surfaces of the hot-rolled steel sheet H) of the hot-rolled steel sheet H is set as positive, in an area with a positive changing speed measured at the fixed point, in a case in which the temperature (the temperature measured at the fixed point) of the hot-rolled steel sheet H is lower than the average temperature of a range of one or more cycles of the wave shape of the hot-rolled steel sheet H, at least one of a direction in which the amount of heat dissipated from the top surface by cooling decreases and a direction in which the amount of heat dissipated from the bottom surface by cooling increases is determined as a control direction, and, in a case in which the temperature of the hot-rolled steel sheet H is higher than the average temperature, at least one of a direction in which the amount of heat dissipated from the top surface by cooling increases and a direction in which the amount of heat dissipated from the bottom surface by cooling decreases is determined as the control direction.

In addition, in an area with a negative changing speed measured at the fixed point, in a case in which the temperature of the hot-rolled steel sheet H is lower than the average temperature, at least one of a direction in which the amount of heat dissipated from the top surface by cooling increases and a direction in which the amount of heat dissipated from the bottom surface by cooling decreases is determined as the control direction; and, in a case in which the temperature of the hot-rolled steel sheet H is higher than the average temperature, at least one of a direction in which the amount of heat dissipated from the top surface by cooling decreases and a direction in which the amount of heat dissipated from the bottom surface by cooling increases is determined as the control direction.

Figure 6:
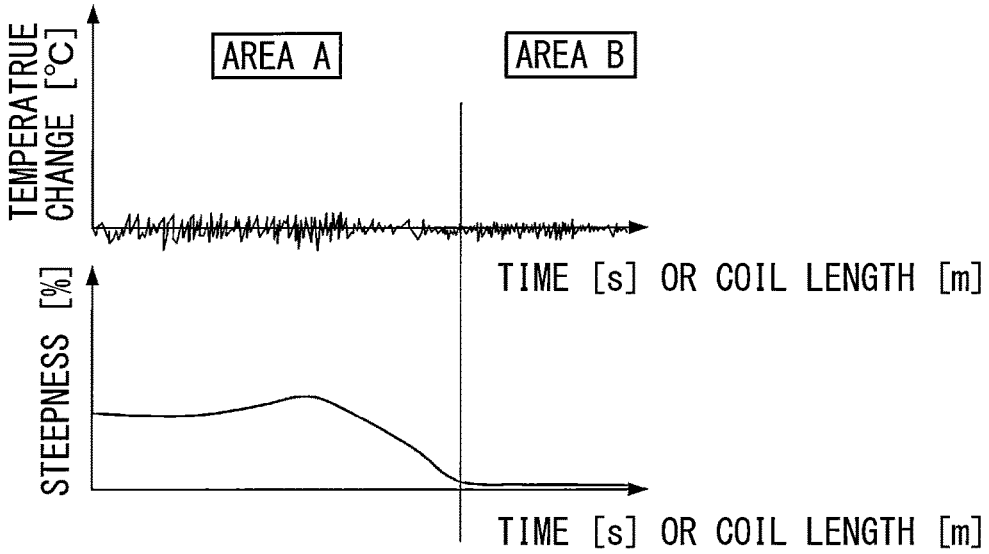
FIG. 6 is a graph illustrating the relationship between the temperature change and steepness of the hot-rolled steel sheet H when an amount of heat dissipated from the top surface by cooling is decreased and an amount of heat dissipated from the bottom surface by cooling is increased in a case in which the temperature of the hot-rolled steel sheet H becomes low with respect to an average temperature of the hot-rolled steel sheet H in an area of a positive changing speed of the hot-rolled steel sheet H and the temperature of the hot-rolled steel sheet H becomes high in an area of a negative changing speed. Meanwhile, the steepness of a wave shape of the hot-rolled steel sheet H refers to a value obtained by dividing an amplitude of the wave shape by a length of a cycle in a rolling direction.

In addition, it was found that, when at least one of the amount of heat dissipated from the top surface by cooling and the amount of heat dissipated from the bottom surface by cooling of the hot-rolled steel sheet H in the cooling section is adjusted based on the control direction determined as described above, as illustrated in FIG. 6, the temperature change occurring in the area A in which the shape of the hot-rolled steel sheet H is not flat can be reduced compared with FIG. 5.

A case in which an opposite operation to the above case is carried out will be described below. In an area with a positive changing speed measured at the fixed point, in a case in which the temperature of the hot-rolled steel sheet H is lower than the average temperature of the hot-rolled steel sheet H, at least one of a direction in which the amount of heat dissipated from the top surface by cooling increases and a direction in which the amount of heat dissipated from the bottom surface by cooling decreases is determined as the control direction, and, in a case in which the temperature of the hot-rolled steel sheet H is higher than the average temperature, at least one of a direction in which the amount of heat dissipated from the top surface by cooling decreases and a direction in which the amount of heat dissipated from the bottom surface by cooling increases is determined as the control direction.

In addition, in an area with a negative changing speed measured at the fixed point, in a case in which the temperature of the hot-rolled steel sheet H is lower than the average temperature, at least one of a direction in which the amount of heat dissipated from the top surface by cooling decreases and a direction in which the amount of heat dissipated from the bottom surface by cooling increases is determined as the control direction, and, in a case in which the temperature of the hot-rolled steel sheet H is higher than the average temperature, at least one of a direction in which the amount of heat dissipated from the top surface by cooling increases and a direction in which the amount of heat dissipated from the bottom surface by cooling decreases is determined as the control direction.

Figure 7:
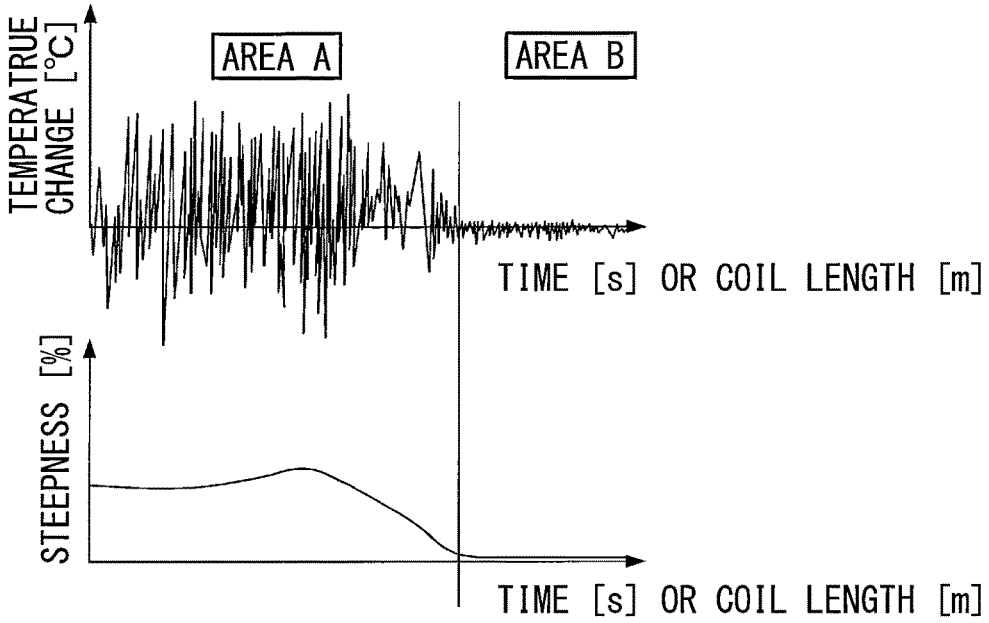
FIG. 7 is a graph illustrating the relationship between the temperature change and steepness of the hot-rolled steel sheet H when the amount of heat dissipated from the top surface by cooling is increased and the amount of heat dissipated from the bottom surface by cooling is decreased in a case in which the temperature of the hot-rolled steel sheet H is low with respect to the average temperature of the hot-rolled steel sheet H in the area of a positive changing speed of the hot-rolled steel sheet H and the temperature of the hot-rolled steel sheet H becomes high in the area of a negative changing speed.

In addition, it was found that, when at least one of the amount of heat dissipated from the top surface by cooling and the amount of heat dissipated from the bottom surface by cooling of the hot-rolled steel sheet H in the cooling section is adjusted based on the control direction determined as described above, as illustrated in FIG. 7, the temperature change occurring in the area. A in which the shape of the hot-rolled steel sheet H is not flat enlarges compared with FIG. 5. Meanwhile, in the examples described herein, an assumption does not apply in which the cooling end temperature may be changed.

Use of the above relationship clarifies which cooling capability of the top side cooling device 14*a* and the bottom side cooling device 14*b* in the cooling apparatus 14 needs to be adjusted in order to reduce the temperature change, that is, the temperature standard deviation. Meanwhile, the above relationship is summarized in Table 1.

TABLE 1

| | | Changing speed | | | |
|---|---|---|---|---|---|
| | | Positive | | Negative | |
| Temperature | | Low | High | Low | High |
| Amount of heat dissipated by cooling | Top surface side | Decrease | Increase | Increase | Decrease |
| | Bottom surface side | Increase | Decrease | Decrease | Increase |

The apparatus for cooling a hot-rolled steel sheet of the present embodiment is to realize the above-described cooling method. That is, the average temperature computation unit 51 in the control device 50 computes the chronological average value of the temperature measurement results obtained from the thermometer 40 in chronological order as the average temperature. In addition, the changing speed computation unit 52 computes the changing speed of the hot-rolled steel sheet H as an average temperature based on the shape measurement results obtained from the shape meter 41 in chronological order.

When upward in the vertical direction of the hot-rolled steel sheet H is set as positive, in an area with a positive changing speed measured at the fixed point, in a case in which the temperature (the temperature measured at the fixed point) of the hot-rolled steel sheet H is lower than the average temperature of a range of one or more cycles of the wave shape of the hot-rolled steel sheet H, the control direction-determining unit 53 determines at least one of a direction in which the amount of heat dissipated from the top surface by cooling decreases and a direction in which the amount of heat dissipated from the bottom surface by cooling increases as a control direction, and, in a case in which the temperature of the hot-rolled steel sheet H is higher than the average temperature, the control direction-determining unit 53 determines at least one of a direction in which the amount of heat dissipated from the top surface by cooling increases and a direction in which the amount of heat dissipated from the bottom surface by cooling decreases as the control direction.

In addition, in an area with a negative changing speed measured at the fixed point, in a case in which the temperature of the hot-rolled steel sheet H is lower than the average temperature, the control direction-determining unit 53 determines at least one of the direction in which the amount of heat dissipated from the top surface by cooling increases and the direction in which the amount of heat dissipated from the bottom surface by cooling decreases as the control direction; and, in a case in which the temperature of the hot-rolled steel sheet H is higher than the average temperature, the control direction-determining unit 53 determines at least one of the direction in which the amount of heat dissipated from the top surface by cooling decreases and the direction in which the amount of heat dissipated from the bottom surface by cooling increases as the control direction.

In addition, the total amount of heat dissipated by cooling-adjusting unit 54 adjusts the total value of the amount of heat dissipated from the top surface by cooling and the amount of heat dissipated from the bottom surface by cooling of the hot-rolled steel sheet H in the cooling section based on the control directions determined as described above.

Meanwhile, when adjusting the cooling capability of the top side cooling device 14*a* and the cooling capability of the bottom side cooling device 14*b*, for example, the cooling headers connected to cooling holes 31 in the top side cooling device 14*a* and the cooling headers connected to cooling holes 31 in the bottom side cooling device 14*b* may be on-off controlled respectively. Alternatively, the cooling capabilities of the respective cooling headers in the top side cooling device 14*a* and the bottom side cooling device 14*b* may be controlled. That is, at least one of the sprayed water density, pressure and water temperature of cooling water sprayed from the respective cooling holes 31 may be adjusted.

In addition, the flow rate or pressure of cooling water sprayed from the top side cooling device 14*a* and the bottom side cooling device 14*b* may be adjusted by thinning out the cooling headers (cooling holes 31) of the top side cooling device 14*a* and the bottom side cooling device 14*b*. For example, in a case in which the cooling capability of the top side cooling device 14*a* before thinning out the cooling headers is superior to the cooling capability of the bottom side cooling device 14*b*, the cooling headers that constitute the top side cooling device 14*a* are preferably thinned out.

The hot-rolled steel sheet H is uniformly cooled by spraying cooling water onto the top surface of the hot-rolled steel sheet H from the top side cooling device 14*a* and spraying cooling water onto the bottom surface of the hot-rolled steel sheet H from the bottom side cooling device 14*b* using the cooling capabilities adjusted as described above.

After that, the temperature and shape of the hot-rolled steel sheet H cooled using the cooling apparatus 14 are measured at the same point of the fixed point respectively using the thermometer 40 and the shape meter 41, and the temperature and the shape are measured as chronological data. Meanwhile, the temperature measurement area includes all the area of the hot-rolled steel sheet H in the width direction. In addition, the shape indicates the amount of change of the hot-rolled steel sheet H in the height direction observed in a measurement at the fixed point. Furthermore, similarly to the temperature measurement area, the shape measurement area includes all the area of the hot-rolled steel sheet H in the width direction. When the sampling times are multiplied by the sheet-threading speed, it becomes possible to link the chronological data of the measurement results of the temperature, the changing speed and the like to the locations in the rolling direction.

As described using FIGS. 4, 5, 6 and 7, in an area with a positive changing speed at the fixed point in the hot-rolled steel sheet H, in a case in which the temperature of the hot-rolled steel sheet H at the fixed point is lower than the average temperature at the fixed point, it is possible to reduce the temperature standard deviation by decreasing the top side cooling capability (the amount of heat dissipated from the top surface by cooling). Similarly, it is possible to reduce the temperature standard deviation by increasing the bottom side cooling capability (the amount of heat dissipated from the bottom surface by cooling). Use of the above relationship clarifies which cooling capability of the top side cooling device 14*a* and the bottom side cooling device 14*b* in the cooling apparatus 14 needs to be adjusted in order to reduce the temperature standard deviation.

That is, understanding of the change of temperature with respect to location linked to the wave shape of the hot-rolled steel sheet H enables clarifying which of the top side cooling and the bottom side cooling causes the currently occurring temperature standard deviation. Therefore, the increase and decrease directions (control directions) of the top side cooling capability (amount of heat dissipated from the top surface by cooling) and the bottom side cooling capability (amount of heat dissipated from the bottom surface by cooling) for decreasing the temperature standard deviation are determined, and it is possible to adjust the top and bottom heat transfer coefficient ratio.

In addition, it is possible to determine the top and bottom heat transfer coefficient ratio based on the degree of the temperature standard deviation so that the temperature standard deviation falls into a permissible range, for example, a range of the minimum value to the minimum value+10° C. Meanwhile, when the temperature standard deviation falls into a range of the minimum value to the minimum value+10° C., the variations in yield stress, tensile strength and the like are suppressed within the manufacturing permissible ranges, and the hot-rolled steel sheet H can be uniformly cooled. In addition, although there are large variations, the temperature standard deviation falls into a range of the minimum value to the minimum value+10° C. as long as a sprayed cooling water density ratio is ±5% or less with respect to the sprayed cooling water density ratio at which the temperature standard deviation becomes the minimum value. That is, in a case in which the sprayed cooling water density is used, the top and bottom ratio of the sprayed cooling water density (sprayed cooling water density ratio) is desirably set to ±5% or less with respect to the sprayed cooling water density ratio at which the temperature standard deviation becomes the minimum value. However, the permissible range does not always include the top and bottom sprayed water density.

According to the above embodiment, the hot-rolled steel sheet H is cooled by adjusting the cooling capabilities of the top side cooling device 14*a* and the bottom side cooling device 14*b*, and then the cooling capability of the top side cooling device 14*a* and the cooling capability of the bottom side cooling device 14*b* are further adjusted based on the measurement results of the temperature and wave shape of the cooled hot-rolled steel sheet H. Since the cooling capabilities of the top side cooling device 14*a* and the bottom side cooling device 14*b* can be adjusted to be qualitatively and quantitatively appropriate cooling capabilities through feedback control in the above manner, it is possible to further improve the uniformity of the hot-rolled steel sheet H which will be cooled afterwards.

As described above, according to the present embodiment, it is possible to uniformly cool the hot-rolled steel sheet H by minimizing the temperature standard deviation of the hot-rolled steel sheet H.

In the above embodiment, the temperature and shape of the hot-rolled steel sheet H are measured at the fixed point at the same measurement location using the thermometer 40 and the shape meter 41; however, as a result of investigation by the inventors, it was found that the measurement locations of the thermometer 40 and the shape meter 41 may not be strictly the same. It was found that, specifically, when the location deviation (distance) L between the temperature measurement place P1 of the thermometer 40 and the shape measurement place P2 of the shape meter 41 on the hot-rolled steel sheet H is 50 mm or less and preferably 30 mm or less as illustrated in FIG. 8, it is possible to appropriately understand the temperature and shape of the hot-rolled steel sheet H.

Figure 8:
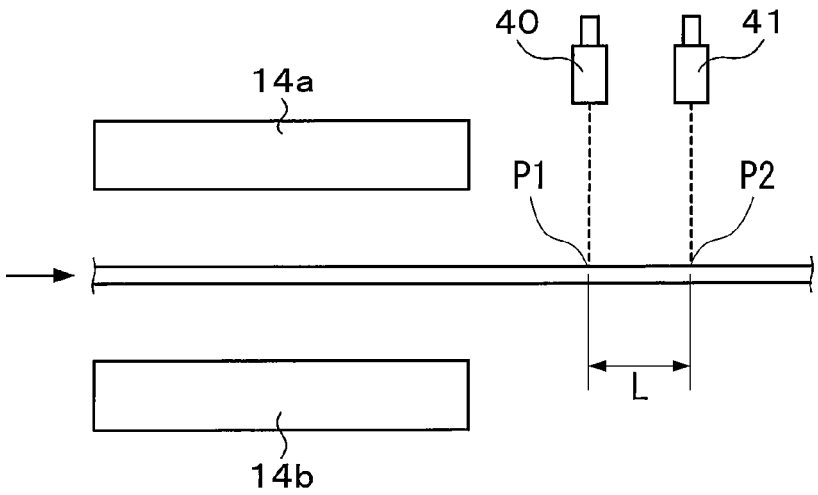
FIG. 8 is an explanatory view illustrating disposition of a thermometer 40 and a shape meter 41 in the hot rolling facility 1.

The direction of the location deviation L between the measurement places of the thermometer 40 and the shape meter 41 may be the sheet-threading direction of the hot-rolled steel sheet H as illustrated in FIG. 8, may be the sheet thickness direction of the hot-rolled steel sheet H, and may be an arbitrary direction. Meanwhile, in the example of FIG. 8, the thermometer 40 is disposed on the upstream side of the shape meter 41, conversely, the shape meter 41 may be disposed on the upstream side of the thermometer 40.

Here, the reason for the location deviation L between the measurement places of the thermometer 40 and the shape meter 41 being preferably set to 50 mm or less will be described. Table 2 describes the relationship between the temperature standard deviation of the hot-rolled steel sheet H and the differences (the differences of the standard deviations from the minimum value) between the respective temperature standard deviations and the minimum value (the minimum value=10.0 in Table 2) in a case in which the location deviation L between the measurement places of the thermometer 40 and the shape meter 41 is changed in a range of −200 mm to +200 mm in the rolling direction under the same conditions of the top and bottom heat transfer coefficient ratio, the steepness and the sheet-threading speed when the invention is applied to an actual apparatus.

Meanwhile, in Table 2, the temperature measurement place P1 of the thermometer 40 is used as a criterion, a location deviation L is indicated using a positive value in a case in which the shape measurement place P2 of the shape meter 41 is set on the downstream side of the temperature measurement place, and a location deviation L is indicated using a negative value in a case in which the shape measurement place P2 of the shape meter 41 is set on the upstream side of the temperature measurement place. In addition, in a case in which the temperature measurement place P1 of the thermometer 40 and the shape measurement place P2 of the shape meter 41 are set to the same location, the location deviation L becomes zero.

As illustrated in Table 2, it was found that, when the location deviation L between the measurement places of the thermometer 40 and the shape meter 41 was 50 mm or less regardless of whether the value was positive or negative, the difference of the standard deviation from the minimum value can be reduced to +10° C. or less.

TABLE 2

| Location deviation L between thermometer and shape meter (mm) | Temperature standard deviation Y (° C.) | Difference of standard deviation from minimum value (° C.) |
|---|---|---|
| −200.0 | 41.8 | 31.8 |
| −150.0 | 32.3 | 22.3 |
| −100.0 | 21.1 | 11.1 |
| −50.0 | 15.2 | 5.2 |
| 0.0 | 10.0 | 0.0 |
| 50.0 | 16.2 | 6.2 |
| 100.0 | 28.5 | 18.5 |
| 150.0 | 35.1 | 25.1 |
| 200.0 | 40.5 | 30.5 |

Therefore, when the location deviation L between the measurement places of the thermometer 40 and the shape meter 41 is 50 mm or less, similarly to the above embodiment, it is possible to determine the increase and decrease directions (control directions) of the top side cooling capability and the bottom side cooling capability for decreasing the temperature standard deviation, and it is possible to feedback-control the cooling capabilities of the top side cooling device 14*a* and the bottom side cooling device 14*b*.

Figure 9:
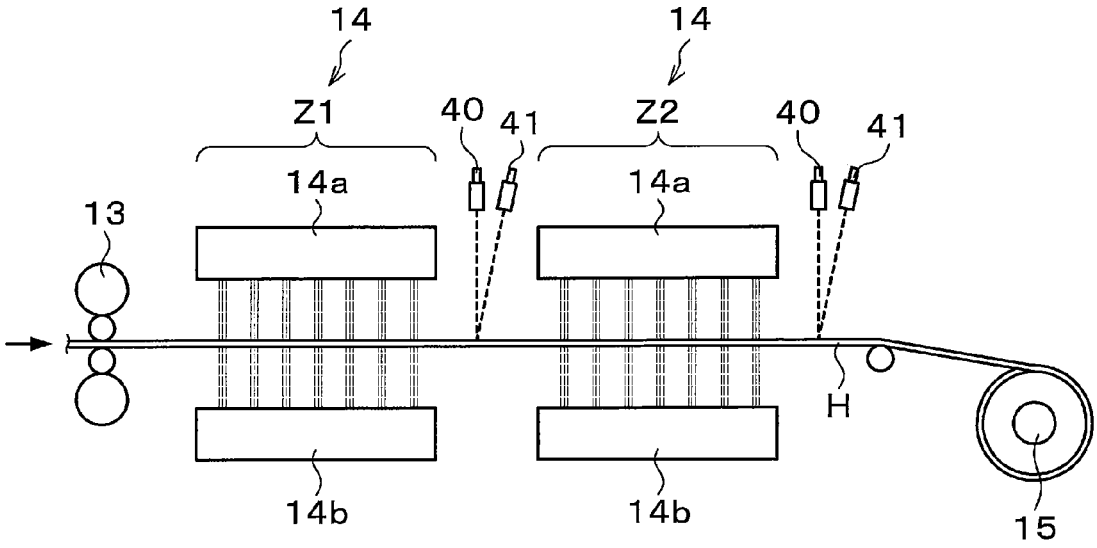
FIG. 9 is an explanatory view illustrating a modified example of the cooling apparatus 14 in the hot rolling facility 1.

In the above embodiment, the cooling section in which the hot-rolled steel sheet H is cooled may be divided into a plurality of sections, for example, two divided cooling sections Z1 and Z2 in the rolling direction as illustrated in FIG. 9. Each of the divided cooling sections Z1 and Z2 is provided with the cooling apparatus 14. In addition, the thermometer 40 and the shape meter 41 are provided respectively at the border between the respective divided cooling sections Z1 and Z2, that is, on the downstream side of the divided cooling sections Z1 and Z2. Meanwhile, in the embodiment, the cooling section is divided into two divided cooling sections, but the number of divisions is not limited thereto, and can be arbitrarily set. For example, the cooling section may be divided into 1 to 5 divided cooling sections.

In this case, the temperature and wave shape of the hot-rolled steel sheet H on the downstream side of the divided cooling sections Z1 and Z2 are respectively measured using the respective thermometers 40 and the respective shape meters 41. In addition, the cooling capabilities of the top side cooling device 14*a* and the bottom side cooling device 14*b* at the respective divided cooling sections Z1 and Z2 are controlled based on the measurement results. At this time, the cooling capabilities are controlled so that the temperature standard deviation of the hot-rolled steel sheet H falls into the permissible range, for example, a range of the minimum value to the minimum value+10° C. as described above. Thereby, at least one of the amount of heat dissipated from the top surface by cooling and the amount of heat dissipated from the bottom surface by cooling of the hot-rolled steel sheet H at the respective divided cooling sections Z1 and Z2 is adjusted.

For example, in the divided cooling section Z1, the cooling capabilities of the top side cooling device 14*a* and the bottom side cooling device 14*b* are feedback-controlled based on the measurement results of the thermometer 40 and the shape meter 41 on the downstream side, thereby at least one of the amount of heat dissipated from the top surface by cooling and the amount of heat dissipated from the bottom surface by cooling is adjusted.

In addition, in the divided cooling section Z2, the cooling capabilities of the top side cooling device 14*a* and the bottom side cooling device 14*b* may be feedforward-controlled or feedback-controlled based on the measurement results of the thermometer 40 and the shape meter 41 on the downstream side. In any cases, in the divided cooling section Z2, at least one of the amount of heat dissipated from the top surface by cooling and the amount of heat dissipated from the bottom surface by cooling is adjusted.

Since the method for controlling the cooling capabilities of the top side cooling device 14*a* and the bottom side cooling device 14*b* based on the measurement results of the thermometer 40 and the shape meter 41 is the same as in the above embodiment described using FIGS. 4 to 7, the method will not be described in detail.

In this case, since at least one of the amount of heat dissipated from the top surface by cooling and the amount of heat dissipated from the bottom surface by cooling of the hot-rolled steel sheet H is adjusted in the respective divided cooling sections Z1 and Z2, finer control becomes possible. Therefore, it is possible to more uniformly cool the hot-rolled steel sheet H.

In the above embodiment, in the respective divided cooling sections Z1 and Z2, when adjusting at least one of the amount of heat dissipated from the top surface by cooling and the amount of heat dissipated from the bottom surface by cooling of the hot-rolled steel sheet H, at least one of the steepness of the wave shape of the hot-rolled steel sheet H and the sheet-threading speed of the hot-rolled steel sheet H may be used in addition to the measurement results of the thermometer 40 and the shape meter 41. For example, since there are cases in which the steepness or sheet-threading speed of the hot-rolled steel sheet H is different for each coil, the steepness or the sheet-threading speed is also taken into consideration.

Figure 10:
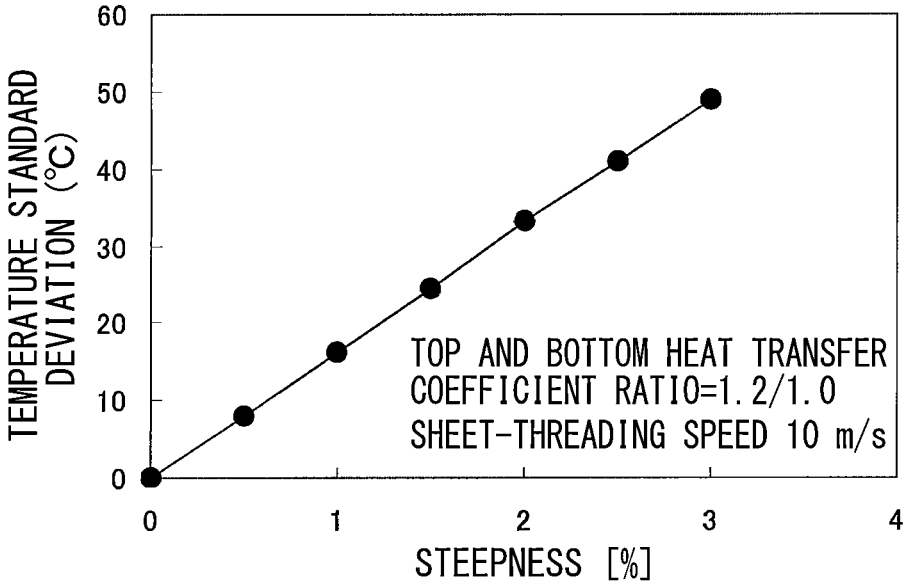
FIG. 10 is a graph illustrating a relationship between the steepness and temperature standard deviation of the hot-rolled steel sheet H.
Figure 11:
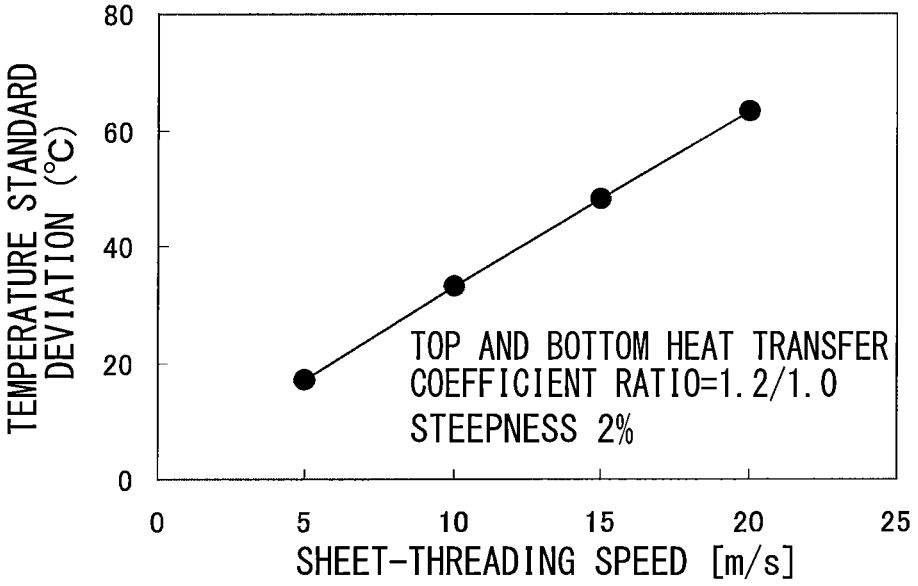
FIG. 11 is a graph illustrating a relationship between the sheet-threading speed and temperature standard deviation of the hot-rolled steel sheet H.

According to the investigation by the inventors, for example, when the steepness of the wave shape of the hot-rolled steel sheet H becomes large as illustrated in FIG. 10, the temperature standard deviation of the hot-rolled steel sheet H becomes large. In addition, for example, when the sheet-threading speed of the hot-rolled steel sheet H becomes a fast speed as illustrated in FIG. 11, the temperature standard deviation of the hot-rolled steel sheet H becomes large.

In a case in which the steepness or sheet-threading speed of the hot-rolled steel sheet H is not constant as described above, the change of the temperature standard deviation with respect to the top and bottom heat transfer coefficient ratio can be qualitatively evaluated, but cannot be accurately quantitatively evaluated. Therefore, the temperature standard deviation is corrected by, for example, obtaining a temperature standard deviation in accordance with the steepness or sheet-threading speed of the hot-rolled steel sheet H in advance and measuring at least the steepness or sheet-threading speed of the hot-rolled steel sheet H. In addition, the amount of heat dissipated from the top surface by cooling and the amount of heat dissipated from the bottom surface by cooling of the hot-rolled steel sheet H in the respective divided cooling sections Z1 and Z2 are corrected based on the corrected temperature standard deviation. Thereby, it is possible to more uniformly cool the hot-rolled steel sheet H.

Figure 12:
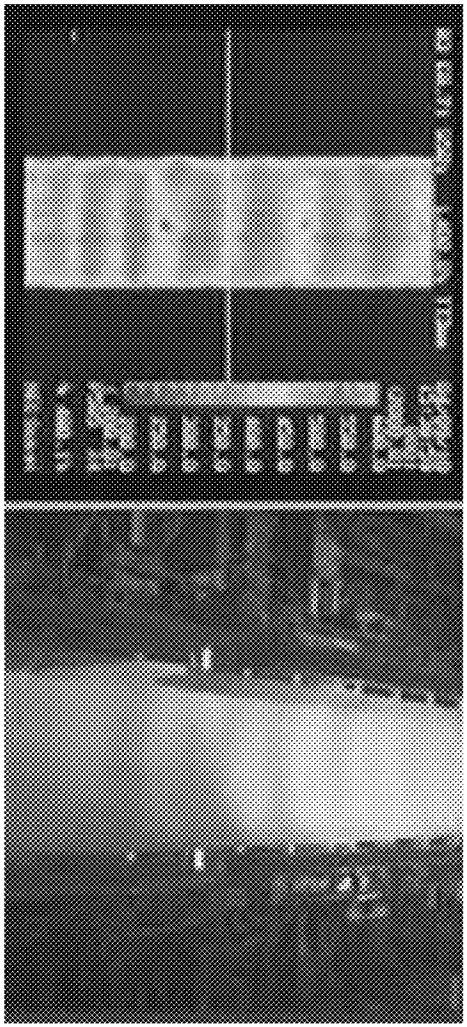
FIG. 12 is an explanatory view illustrating a pattern in which a temperature standard deviation is formed in a sheet width direction of the hot-rolled steel sheet H.

In addition, according to the present embodiment, it becomes possible to finish the hot-rolled steel sheet so that a uniform shape or material is formed in the sheet width direction of the hot-rolled steel sheet H as well. FIG. 12 illustrates an example of a wave shape having an amplitude changing in the sheet width direction due to elongation at the center. As such, even in a case in which a temperature standard deviation is caused by the wave shape having an amplitude changing in the sheet width direction, according to the above-described embodiment, it becomes possible to reduce the temperature standard deviation in the sheet width direction.

Here, as a result of thorough studies, the inventors found that, when the sheet-threading speed of the hot-rolled steel sheet H is set in a range of 550 m/min to the mechanical limit speed, it is possible to more uniformly cool the hot-rolled steel sheet H.

It was found that, when the sheet-threading speed of the hot-rolled steel sheet H is set to 550 m/min or more, the influence of soaked water on the hot-rolled steel sheet H becomes significantly small even when cooling water is sprayed onto the hot-rolled steel sheet H. Therefore, it is possible to prevent the ununiform cooling of the hot-rolled steel sheet H due to soaked water.

Figure 13:
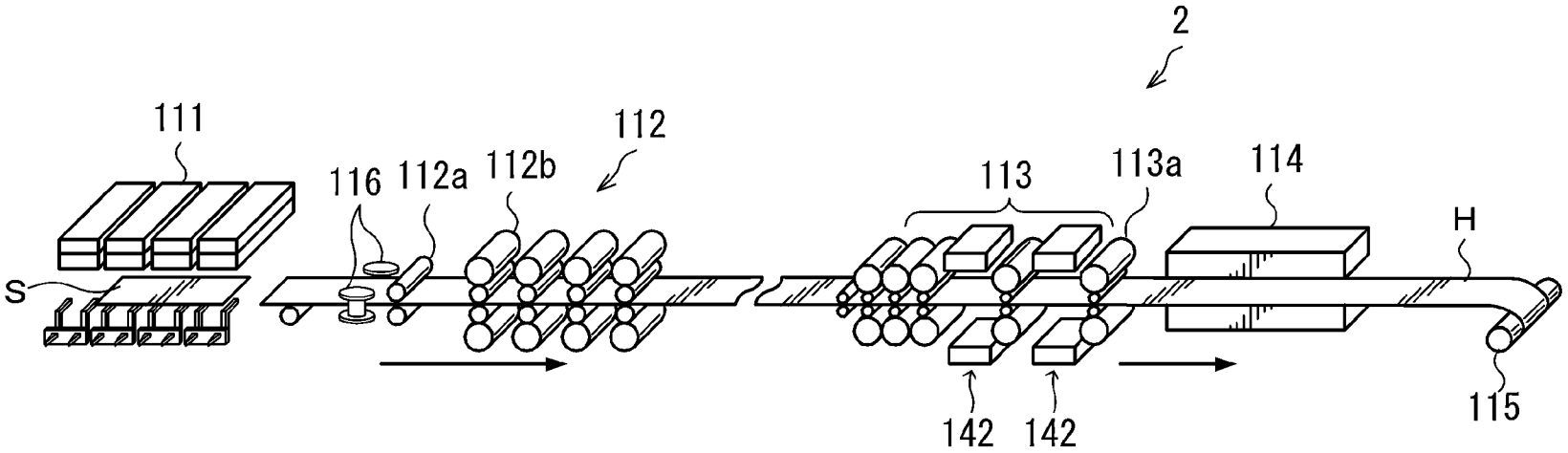
FIG. 13 is an explanatory view illustrating a hot rolling facility 2 for realizing a method for cooling the hot-rolled steel sheet H in another embodiment.

FIG. 13 schematically illustrates an example of a hot rolling facility 2 in another embodiment. The hot rolling facility 2 is a facility aimed to sandwich the top and bottom of a heated slab S using rolls, continuously roll the slab to make the slab as thin as a minimum of 1.2 mm, and coil the slab.

The hot rolling facility 2 has a heating furnace 111 for heating the slab S, a width-direction mill 116 that rolls the slab S heated in the heating furnace 111 in a width direction, a roughing mill 112 that rolls the slab S rolled in the width direction from the vertical direction so as to produce a rough bar, a finishing mill 113 that further continuously hot-finishing-rolls the rough bar to a predetermined thickness, a cooling apparatus 114 that cools the hot-rolled steel sheet H hot-finishing-rolled using the finishing mill 113 using cooling water, and a coiling apparatus 115 that coils the hot-rolled steel sheet H cooled using the cooling apparatus 114 into a coil shape.

The heating furnace 111 is provided with a side burner, an axial burner and a roof burner that heat the slab S brought from the outside through a charging hole by blowing flame. The slab S brought into the heating furnace 111 is sequentially heated in respective heating areas formed in respective zones, and, furthermore, a heat-retention treatment for enabling transportation at an optimal temperature is carried out by uniformly heating the slab S using the roof burner in a soaking area formed in a final zone. When a heating treatment in the heating furnace 111 completely ends, the slab S is transported to the outside of the heating furnace 111, and moved into a rolling process by the roughing mill 112.

In the roughing mill 112, the slab S transported from the heating furnace 111 is passed through gaps between columnar rotary rolls provided across a plurality of stands. For example, the roughing mill 112 hot-rolls the slab S only using work rolls 112*a* provided at the top and bottom of a first stand so as to form a rough bar.

Next, the rough bar which has passed through the work rolls 112*a* is further continuously rolled using a plurality of fourfold mills 112*b* constituted by a work roll and a back-up roll. As a result, when the rough rolling process ends, the rough bar is rolled into a thickness of approximately 30 mm to 60 mm, and transported to the finishing mill 113. Meanwhile, the configuration of the roughing mill 112 is not limited to what has been described in the embodiment, and the number of rolls and the like can be arbitrarily set.

The finishing mill 113 finishing-rolls the rough bar transported from the roughing mill 112 until the thickness becomes approximately several millimeters. The finishing mill 113 passes the rough bar through gaps between top and bottom finish rolling rolls 113*a* linearly arranged across 6 to 7 stands so as to gradually reduce the rough bar. The hot-rolled steel sheet H finishing-rolled using the finishing mill 113 is transported to the cooling apparatus 114 using transportation rolls 132 (refer to FIG. 14). Meanwhile, a mill having the above-described pair of finish rolling rolls 113*a* linearly arrayed vertically is also referred to as a so-called rolling stand.

In addition, cooling apparatuses 142 (supplementary cooling apparatus) that carry out inter-stand cooling (supplementary cooling) during finish rolling are disposed between the respective rolling rolls 113*a* arrayed across 6 to 7 stands (that is, between the rolling stands). The details of the apparatus configuration and the like of the cooling apparatus 142 will be described below with reference to FIG. 17. Meanwhile, FIG. 13 illustrates a case in which the cooling apparatuses 142 are disposed at two places in the finishing mill 113, but the cooling apparatuses 142 may be provided between all the rolling rolls 113*a*, or may be provided between some of the rolling rolls.

Figure 14:
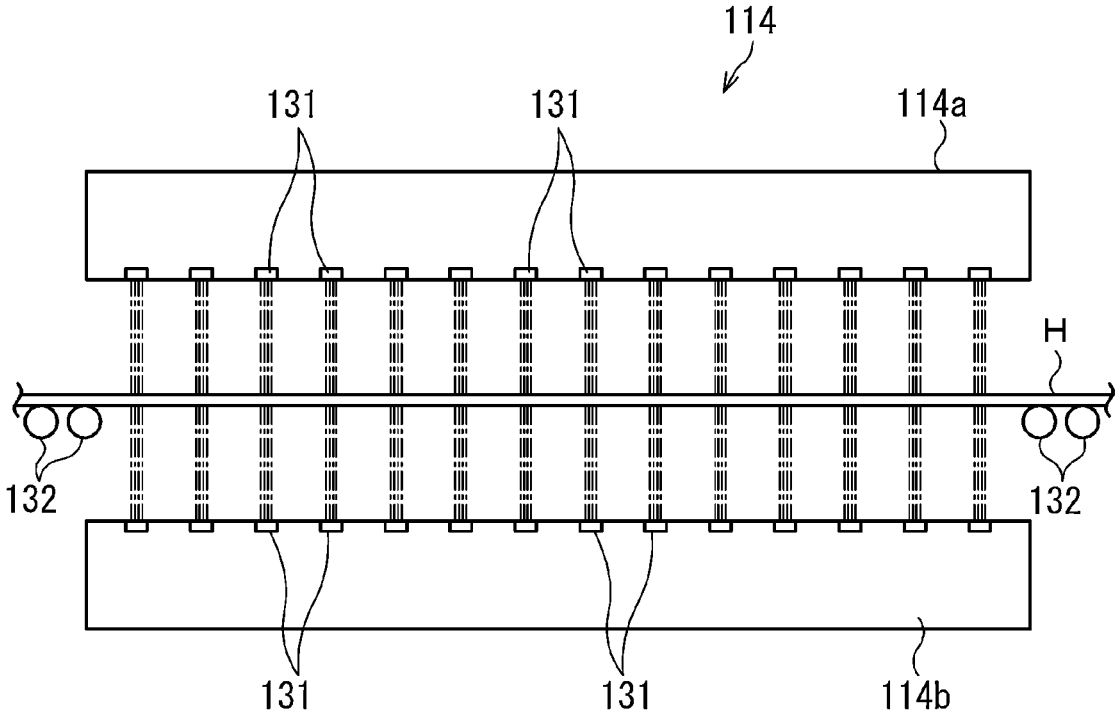
FIG. 14 is an explanatory view illustrating an outline of a configuration of a cooling apparatus 114 provided in the hot rolling facility 2.

The cooling apparatus 114 is a facility for carrying out nozzle cooling on the hot-rolled steel sheet H transported from the finishing mill 113 through laminating or spraying. As illustrated in FIG. 14, the cooling apparatus 114 has a top side cooling device 114*a* that sprays cooling water from cooling holes 131 on the top side to the top surface of the hot-rolled steel sheet H moving on the transportation rolls 132 in a run-out table, and a bottom side cooling device 114*b* that sprays cooling water from cooling holes 131 on the bottom side to the bottom surface of the hot-rolled steel sheet H.

A plurality of the cooling holes 131 is provided in the top side cooling device 114*a* and the bottom side cooling device 114*b* respectively. In addition, a cooling header (not illustrated) is connected to the cooling holes 131. The number of the cooling holes 131 determines the cooling capabilities of the top side cooling device 114*a* and the bottom side cooling device 114*b*. Meanwhile, the cooling apparatus 114 may be constituted by at least one of top and bottom split laminar, pipe laminar, spray cooling and the like.

In the cooling apparatus 114, when adjusting the cooling capability of the top side cooling device 114*a* and the cooling capability of the bottom side cooling device 114*b*, for example, the cooling headers connected to cooling holes 131 in the top side cooling device 114*a* and the cooling headers connected to cooling holes 131 in the bottom side cooling device 114*b* may be on-off controlled respectively.

Alternatively, the operation parameters of the respective cooling headers in the top side cooling device 114*a* and the bottom side cooling device 114*b* may be controlled. That is, at least one of the sprayed water density, pressure and water temperature of cooling water sprayed from the respective cooling holes 131 may be adjusted.

In addition, the flow rate or pressure of cooling water sprayed from the top side cooling device 114*a* and the bottom side cooling device 114*b* may be adjusted by thinning out the cooling headers (cooling holes 131) of the top side cooling device 114*a* and the bottom side cooling device 114*b*. For example, in a case in which the cooling capability of the top side cooling device 114*a* before thinning out the cooling headers is superior to the cooling capability of the bottom side cooling device 114*b*, the cooling headers that constitute the top side cooling device 114*a* are preferably thinned out.

The coiling apparatus 115 coils the hot-rolled steel sheet H cooled using the cooling apparatus 114 at a predetermined coiling temperature as illustrated in FIG. 13. The hot-rolled steel sheet H coiled into a coil shape using the coiling apparatus 115 is transported to the outside of the hot rolling facility 2.

In a case in which the hot-rolled steel sheet H having a wave shape with a surface height (wave height) changing in the rolling direction is cooled in the cooling apparatus 114 of the hot rolling facility 2 constituted as described above, as described above, it is possible to uniformly cool the hot-rolled steel sheet H by appropriately adjusting the water quantity densities, pressures, water temperatures and the like of cooling water sprayed from the top side cooling device 114*a* and cooling water sprayed from the bottom side cooling device 114*b*. However, particularly, in a case in which the sheet-threading speed of the hot-rolled steel sheet H is slow, a period of time during which the hot-rolled steel sheet H and the transportation rolls 132 or aprons 133 locally come into contact with each other becomes long, and the contact portions of the hot-rolled steel sheet H with the transportation rolls 132 or the aprons 133 become easily coolable due to heat dissipation by contact, and therefore cooling becomes ununiform. The causes of the ununiformity of the cooling will be described below with reference to the accompanying drawings.

Figure 15A:
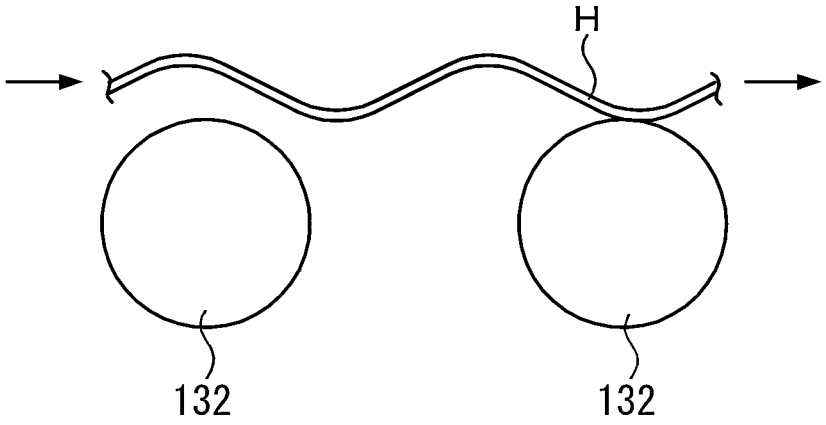
FIG. 15A is an explanatory view illustrating a shape in which a bottom point of the hot-rolled steel sheet H comes into contact with a transportation roll 132.
Figure 15B:
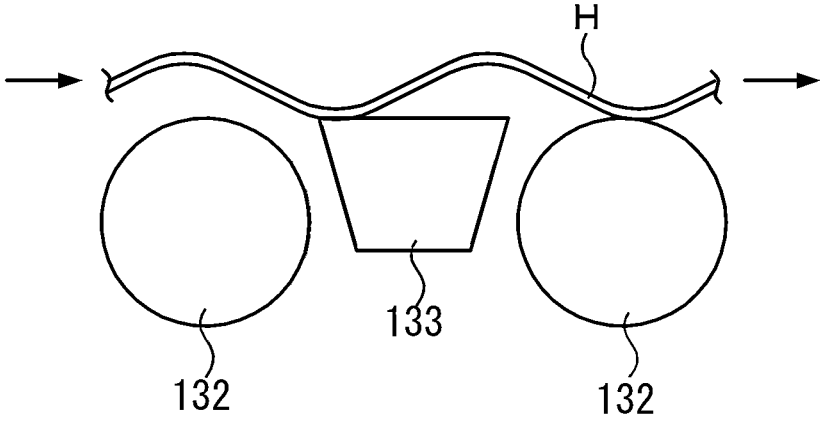
FIG. 15B is an explanatory view illustrating a shape in which the bottom point of the hot-rolled steel sheet H comes into contact with the transportation roll 132 and an apron 133.

As illustrated in FIG. 15A, in a case in which the hot-rolled steel sheet H has a wave shape in the rolling direction, there is a possibility of the bottom portion of the wave shape of the hot-rolled steel sheet H locally coming into contact with the transportation rolls 132. In addition, there are cases in which the apron 133 is provided between the adjacent transportation rolls 132 in the rolling direction as a support for preventing the hot-rolled steel sheet H from dropping as illustrated in FIG. 15B. In this case, there is a possibility of the bottom portion of the wave shape of the hot-rolled steel sheet H locally coming into contact with the transportation rolls 132 and the aprons 133. As such, in the hot-rolled steel sheet H, portions that locally come into contact with the transportation rolls 132 or the aprons 133 become more easily coolable than other portions due to heat dissipation by contact. Therefore, the hot-rolled steel sheet H is ununiformly cooled.

Figure 16A:
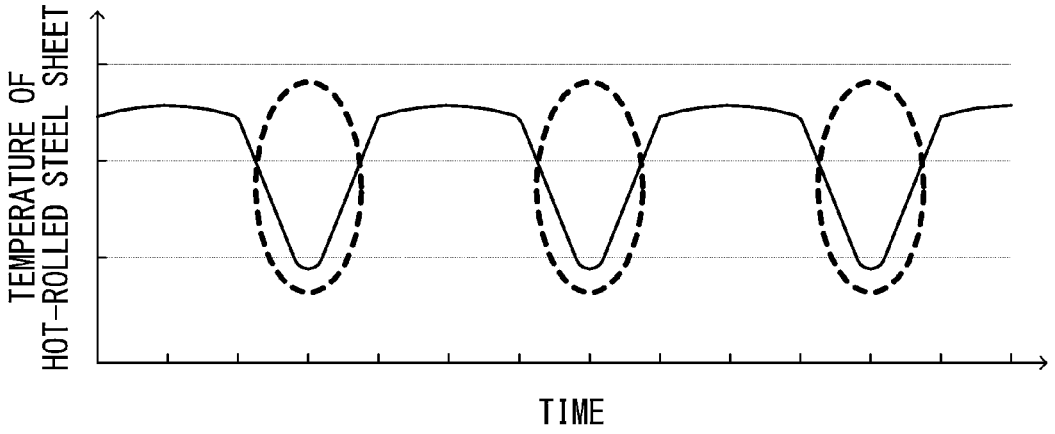
FIG. 16A is a graph illustrating a change of the temperature of the hot-rolled steel sheet H over time in a case in which the sheet-threading speed of the hot-rolled steel sheet H is slow.

Particularly, in a case in which the sheet-threading speed of the hot-rolled steel sheet H is slow, a period of time during which the hot-rolled steel sheet H locally comes into contact with the transportation rolls 132 or the aprons 133 becomes long. As a result, portions at which the hot-rolled steel sheet H locally comes into contact with the transportation rolls 132 or the aprons 133 (portions surrounded by the dotted line in FIG. 16A) become more easily coolable than other portions as illustrated in FIG. 16A, and the hot-rolled steel sheet H is ununiformly cooled.

On the other hand, when the sheet-threading speed of the hot-rolled steel sheet H is set to a fast speed, the contact period of time becomes short. Furthermore, when the sheet-threading speed is increased, the hot-rolled steel sheet H in the process of sheet-threading becomes floated from the transportation rolls 132 or the aprons 133 due to repulsion by the contact between the hot-rolled steel sheet H and the transportation rolls 132 or the aprons 133.

In addition, when the sheet-threading speed is increased, the hot-rolled steel sheet H does not only become floated from the transportation rolls 132 or the aprons 133 due to repulsion by the contact, but the contact period of time or number of contacts between the hot-rolled steel sheet H and the transportation rolls 132 or the aprons 133 also decreases, and therefore the temperature decrease by the contact becomes negligible.

Figure 16B:
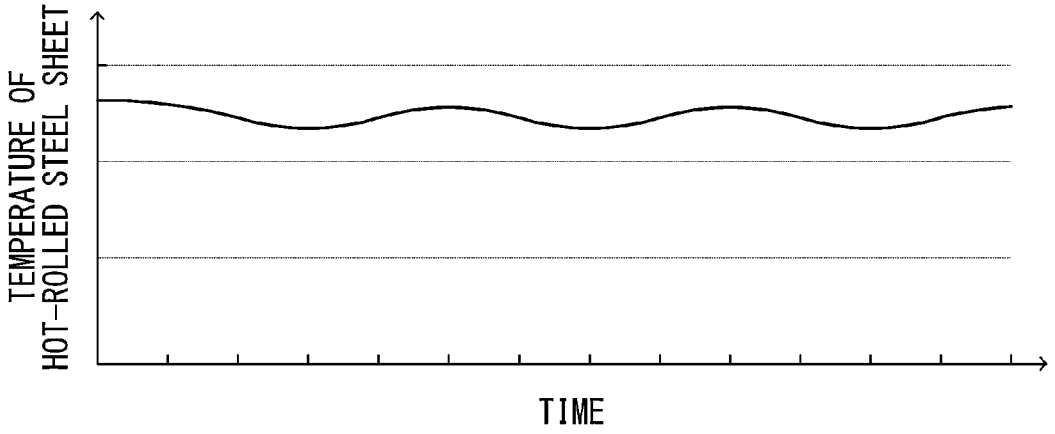
FIG. 16B is a graph illustrating a change of the temperature of the hot-rolled steel sheet H over time in a case in which the sheet-threading speed of the hot-rolled steel sheet H is high.

Therefore, the heat dissipation by contact can be suppressed by increasing the sheet-threading speed, and the hot-rolled steel sheet H can be more uniformly cooled as illustrated in FIG. 16B. In addition, the inventors found that the hot-rolled steel sheet H can be sufficiently uniformly cooled by setting the sheet-threading speed to 550 m/min or more in addition to the above-described control of the amounts of heat dissipated from the top and bottom surfaces.

Meanwhile, the above finding is about the cooling of the hot-rolled steel sheet H having a wave shape; however, regardless of the height of the wave shape, the lowermost point of the hot-rolled steel sheet H comes into contact with the transportation rolls 132 or the aprons 133, and therefore, regardless of the height of the wave shape, an increase in the sheet-threading speed is effective for uniform cooling.

In addition, when the sheet-threading speed of the hot-rolled steel sheet H is set to 550 m/min or more, since the hot-rolled steel sheet H becomes floated from the transportation rolls 132 or the aprons 133, there is no soaked water on the hot-rolled steel sheet H as in the related art even when cooling water is sprayed onto the hot-rolled steel sheet H in the above state. Therefore, it is possible to prevent the hot-rolled steel sheet H from being ununiformly cooled due to soaked water.

As described above, when the sheet-threading speed of the hot-rolled steel sheet H in the cooling section is set to 550 m/min or more, it is possible to more uniformly cool the hot-rolled steel sheet H having a wave shape with a height periodically changing in the rolling direction.

Meanwhile, the sheet-threading speed of the hot-rolled steel sheet H is preferably a faster speed, but it is impossible to exceed the mechanical limit speed (for example, 1550 m/min). Therefore, practically, the sheet-threading speed of the hot-rolled steel sheet H in the cooling section is set in a range of 550 m/min to the mechanical limit speed. In addition, in a case in which the upper limit value of the sheet-threading speed in an actual operation (operation upper limit speed) is set in advance, the sheet-threading speed of the hot-rolled steel sheet H is preferably set in a range of 550 m/min to the operation upper limit speed (for example, 1200 m/min).

Naturally, the control of the amount of heat dissipated from the top surface by cooling and the amount of heat dissipated from the bottom surface by cooling of the hot-rolled steel sheet H and the setting of the sheet-threading speed to a fast speed (set in a range from 550 m/min to the mechanical limit speed) may be combined by applying the apparatus for cooling a hot-rolled steel sheet described using FIG. 3 to the hot rolling facility 2.

In addition, in general, in the case of the hot-rolled steel sheet H having a large tensile strength (particularly, a steel sheet called so-called high tensile strength steel having a tensile strength (TS) of 800 MPa or more and an experimental upper limit of 1400 MPa), it is known that heat generation by working occurring in the hot rolling facility 2 during rolling is increased due to a high hardness of the hot-rolled steel sheet H. Therefore, in the related art, the hot-rolled steel sheet H was sufficiently cooled by suppressing the sheet-threading speed of the hot-rolled steel sheet H in the cooling apparatus 114 (that is, the cooling section) to be low.

However, when the sheet-threading speed of the hot-rolled steel sheet H in the cooling apparatus 114 is suppressed to be low, in a case in which a wave shape is formed in the hot-rolled steel sheet H, the local contacts between the hot-rolled steel sheet H and the transportation rolls 132 or the aprons 133 make the contact portions more easily coolable due to heat dissipation by contact as described above, and the hot-rolled steel sheet H is ununiformly cooled.

Therefore, the inventors found that, when cooling is carried out between a pair of finish rolling rolls 113*a* (that is, rolling stands) provided across, for example, 6 to 7 stands in the finishing mill 113 of the hot rolling facility 2 (so-called inter-stand cooling), the heat dissipation by working can be suppressed, and the sheet-threading speed of the hot-rolled steel sheet H in the cooling apparatus 114 can be set to 550 m/min or more. Hereinafter, the inter-stand cooling will be described with reference to FIG. 17.

Figure 17:
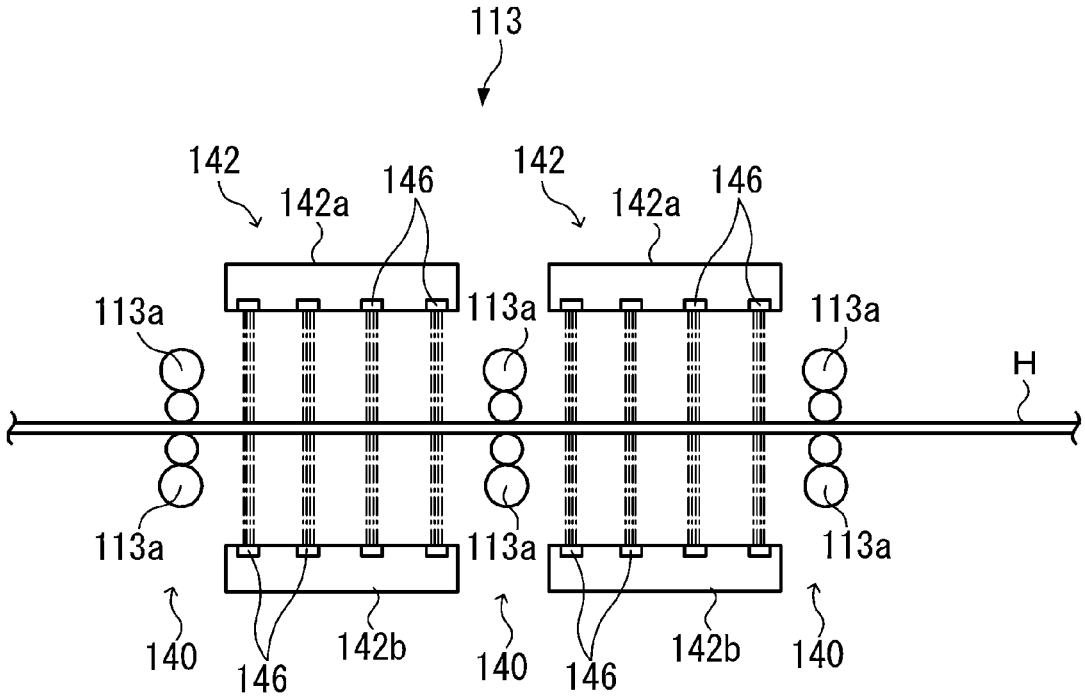
FIG. 17 is an explanatory view of a finishing mill 113 that can carry out inter-stand cooling.
Figure 18:
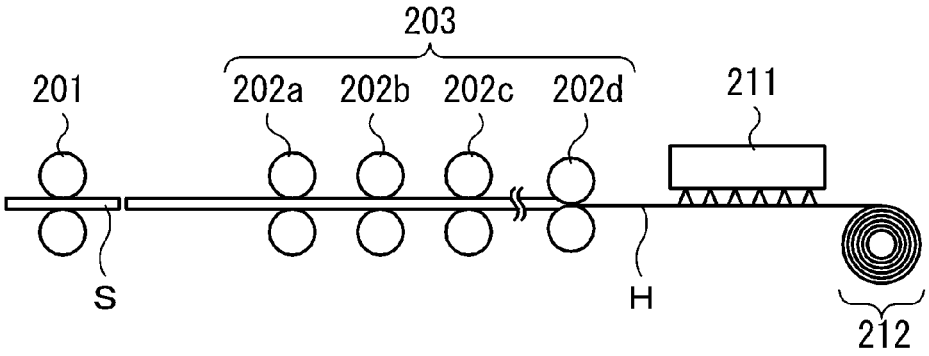
FIG. 18 is an explanatory view illustrating a method for manufacturing the hot-rolled steel sheet H of the related art.

FIG. 17 is an explanatory view of the finishing mill 113 that can carry out the inter-stand cooling, in which a part of the finishing mill 113 is enlarged for the description and three rolling stands are illustrated. Meanwhile, in FIG. 17, the same components as in the above embodiment will be given the same reference numeral. As illustrated in FIG. 17, a plurality (three in FIG. 17) of rolling stands 140 having a pair of vertically linearly arrayed finish rolling rolls 113*a* and the like is provided in the finishing mill 113. The cooling apparatuses 142 which are facilities that carry out nozzle cooling through lamination or spraying are provided between the respective rolling stands 140, which make it possible to carry out the inter-stand cooling on the hot-rolled steel sheet H between the rolling stands 140.

The cooling apparatus 142 has a top side cooling device 142*a* that sprays cooling water from the top side through cooling holes 146 onto the hot-rolled steel sheet H transported in the finishing mill 113 and a bottom side cooling device 142*b* that sprays cooling water from the bottom side onto the hot-rolled steel sheet H as illustrated in FIG. 17. A plurality of the cooling holes 146 is provided respectively in the top side cooling device 142*a* and the bottom side cooling device 142*b*. In addition, a cooling header (not illustrated) is connected to the cooling hole 146. Meanwhile, the cooling apparatus 142 may be constituted by at least one of top and bottom split laminar, pipe laminar, spray cooling and the like.

In the finishing mill 113 having the configuration illustrated in FIG. 17, particularly, in a case in which the tensile strength (TS) of the hot-rolled steel sheet H is 800 MPa or more, the heat dissipation by working in the hot-rolled steel sheet H is suppressed by carrying out the inter-stand cooling. Thereby, it becomes possible to maintain the sheet-threading speed of the hot-rolled steel sheet H in the cooling apparatus 114 at 550 m/min or more. Therefore, the problem of the related art caused in a case in which cooling was carried out at a slow sheet-threading speed, which was the local contacts between the hot-rolled steel sheet H and the transportation rolls 132 or the aprons 133 and the contact portions becoming more easily coolable due to heat dissipation by contact is solved, and the hot-rolled steel sheet H can be sufficiently uniformly cooled.

In the above embodiment, the cooling of the hot-rolled steel sheet H using the cooling apparatus 114 is preferably carried out in a temperature range of the exit-side temperature of the finishing mill to the hot-rolled steel sheet H of 600° C. The temperature range in which the temperature of the hot-rolled steel sheet is 600° C. or higher is a so-called film boiling range. That is, in this case, it is possible to avoid the so-called transition boiling area and to water-cool the hot-rolled steel sheet H in the film boiling area. In the transition boiling area, when cooling water is sprayed onto the surface of the hot-rolled steel sheet H, portions covered with a vapor film and portions in which the cooling water is directly sprayed onto the hot-rolled steel sheet H are present in a mixed state on the surface of the hot-rolled steel sheet H. Therefore, it is not possible to uniformly cool the hot-rolled steel sheet H.

On the other hand, in the film boiling area, since the hot-rolled steel sheet H is cooled in a state in which the entire surface of the hot-rolled steel sheet H is covered with a vapor film, it is possible to uniformly cool the hot-rolled steel sheet H. Therefore, it is possible to more uniformly cool the hot-rolled steel sheet H in a range in which the temperature of the hot-rolled steel sheet H is 600° C. or higher as in the embodiment.

Thus far, the preferable embodiment of the present invention has been described with reference to the accompanying drawings, but the present invention is not limited to the above embodiment. It is evident that a person skilled in the art can imagine a variety of modified examples and revised examples within the scope of ideas described in the claims, and it is needless to say that the examples belong to the technical scope of the present invention.

EXAMPLES

The inventors carried out cooling tests on a hot-rolled steel sheet as examples in order to verify that the hot-rolled steel sheet could be uniformly cooled by setting the sheet-threading speed of the hot-rolled steel sheet to 550 m/min or more.

Example 1

Hot-rolled steel sheets with an intermediate wave having a sheet thickness of 2.5 mm, a width of 1200 mm, a tensile strength of 400 MPa and a steepness of 2% were cooled with varying sheet-threading speeds in a cooling apparatus. Specifically, the sheet-threading speeds were 400 m/min, 450 in/min, 500 m/min, 550 m/min, 600 m/min and 650 m/min, and the hot-rolled steel sheets were cooled at the respective sheet-threading speeds 20 times.

In addition, the temperatures of the hot-rolled steel sheets during coiling were measured, and an average value (amount of CT temperature change) of the standard deviations of temperature changes was computed using the temperature measurement results. The evaluation results of the computed CT temperature change amount are described in Table 3 below. Meanwhile, in terms of the evaluation criteria, a case in which the CT temperature change amount was larger than 25° C. was evaluated as ununiform cooling, and a case in which the CT temperature change amount was 25° C. or less was evaluated as uniform cooling.

TABLE 3

| | Sheet-threading speed [m/min] | | | | | |
|---|---|---|---|---|---|---|
| | 400 | 450 | 500 | 550 | 600 | 650 |
| Exit-side finishing temperature [° C.] | 830 | 850 | 870 | 890 | 910 | 930 |
| CT temperature change amount [° C.] | 58 | 37 | 32 | 12 | 8 | 6 |
| Evaluation | C | C | C | B | A | A |

An inter-stand cooling is not carried out under all conditions.
Evaluation C: CT > 25° C. B: 25 ≥ CT ≥ 10 A: 10 > CT As described in Table 3, in a case in which the sheet-threading speed is 500 m/min or less, the amount of CT temperature change is not sufficiently reduced (higher than 25° C.), and the hot-rolled steel sheet is not sufficiently uniformly cooled. On the other hand, in a case in which the sheet-threading speed is 550 m/min or more, it was found that the CT temperature change amount is suppressed to 25° C. or less, and the hot-rolled steel sheet is uniformly cooled. Meanwhile, in a case in which the sheet-threading speed is 600 m/min or more, it was found that, since the CT temperature was suppressed to lower than 10° C. (8° C. and 6° C.), the above condition is more preferable for the uniform cooling of the hot-rolled steel sheet.

Example 2

The inter-stand cooling was carried out on hot-rolled steel sheets with an intermediate wave having a sheet thickness of 2.5 mm, a width of 1200 mm, a tensile strength of 800 MPa and a steepness of 2% so that the exit-side temperature of finish rolling became 880° C., and cooling was carried out with varying sheet-threading speeds in a cooling apparatus. Specifically, the sheet-threading speeds were 400 m/min, 450 m/min, 500 m/min, 550 m/min, 600 m/min and 650 m/min, and the hot-rolled steel sheets were cooled at the respective sheet-threading speeds 20 times.

In addition, the temperatures of the hot-rolled steel sheets during coiling were measured, and an average value (amount of CT temperature change) of the standard deviations of temperature changes was computed using the temperature measurement results. The evaluation results of the computed CT temperature change amount are described in Table 4 below. Meanwhile, the same evaluation criteria as in Example 1 were used, and the inter-stand cooling was not carried out only in a case in which the sheet-threading speed was 400 m/min.

TABLE 4

| | Sheet-threading speed [m/min] | | | | | |
|---|---|---|---|---|---|---|
| | 400 | 450 | 500 | 550 | 600 | 650 |
| Inter-stand cooling | No | Yes | Yes | Yes | Yes | Yes |
| CT temperature change amount [° C.] | 62 | 43 | 28 | 10 | 6 | 6 |
| Evaluation | C | C | C | B | A | A |

An inter-stand cooling was appropriately carried out so that the exit-side temperature after finishing rolling became 880° C.
Evaluation C: CT > 25° C. B: 25 ≥ CT ≥ 10 A: 10 > CT As described in Table 4, in a case in which the sheet-threading speed was 500 m/min or less, even when the inter-stand cooling was carried out, the amount of CT temperature change was not sufficiently reduced (higher than 25° C.), and the hot-rolled steel sheet was not sufficiently uniformly cooled. On the other hand, in a case in which the sheet-threading speed was 550 m/min or more, it was found that the CT temperature change amount was suppressed to 25° C. or less, and the hot-rolled steel sheet was uniformly cooled.

In addition, in cases in which the inter-stand cooling was carried out (that is, the cases described in Table 4), the amount of CT temperature change was suppressed even in the hot-rolled steel sheets having a relatively high hardness (tensile strength 800 MPa). That is, it was found that it became possible to uniformly cool all steel materials, particularly, steel materials having a high hardness by setting the sheet-threading speed during the cooling of the hot-rolled steel sheet to 550 m/min or more, and, additionally, carrying out the inter-stand rolling in a finishing mill.

INDUSTRIAL APPLICABILITY

The present invention is useful when cooling a hot-rolled steel sheet which has been hot-rolled using a finishing mill so as to have a wave shape having a surface height changing in the rolling direction.

DESCRIPTION OF REFERENCE NUMERALS AND SIGNS

1, 2: HOT ROLLING FACILITY
11, 111: HEATING FURNACE
12, 112: ROUGHING MILL
12*a*, 112*a*: WORK ROLL
12*b*, 112*b*: FOURFOLD MILL
13, 113: FINISHING MILL
13*a*, 113*a*: FINISH ROLLING ROLL
14, 114: COOLING APPARATUS
14*a*, 114*a*: TOP SIDE COOLING DEVICE
14*b*, 114*b*: BOTTOM SIDE COOLING DEVICE
15, 115: COILING APPARATUS
16, 116: WIDTH-DIRECTION MILL
31, 131: COOLING HOLE
32, 132: TRANSPORTATION ROLL
40: THERMOMETER
41: SHAPE METER
50: CONTROL DEVICE
51: AVERAGE TEMPERATURE COMPUTATION UNIT
52: CHANGING SPEED COMPUTATION UNIT
53: CONTROL DIRECTION-DETERMINING UNIT
54: TOTAL AMOUNT OF HEAT DISSIPATED BY COOLING-ADJUSTING UNIT
H: HOT-ROLLED STEEL SHEET
S: SLAB
Z1, Z2: DIVIDED COOLING SECTION

The invention claimed is:

1. An apparatus for cooling a hot-rolled steel sheet which cools a hot-rolled steel sheet hot-rolled using a finishing mill in a cooling section provided on a sheet-threading path, the apparatus comprising:

a thermometer that measures a temperature of the hot-rolled steel sheet on a downstream side of the cooling section;

a shape meter that measures a shape of the hot-rolled steel sheet on the downstream side of the cooling section;

a top side cooling device that cools a top surface of the hot-rolled steel sheet in the cooling section;

a bottom side cooling device that cools a bottom surface of the hot-rolled steel sheet in the cooling section; and a control device that controls at least one of an amount of heat dissipated from the top surface by cooling and an amount of heat dissipated from the bottom surface by cooling of the hot-rolled steel sheet in the cooling section by controlling the top side cooling device and the bottom side cooling device based on temperature measurement results of the hot-rolled steel sheet obtained from the thermometer and shape measurement results of the hot-rolled steel sheet obtained from the shape meter, wherein the control device includes:

an average temperature computation unit that computes a chronological average value of the temperature of the hot-rolled steel sheet on the downstream side of the cooling section as an average temperature based on the temperature measurement results;

a changing speed computation unit that computes a changing speed of the hot-rolled steel sheet on the downstream side of the cooling section based on the shape measurement results;

a control direction-determining unit that, when upward in a vertical direction of the hot-rolled steel sheet is set as positive, in an area with a positive changing speed, in a case in which the temperature of the hot-rolled steel sheet is lower than an average temperature of a range of one or more cycles of a wave shape of the hot-rolled steel sheet, determines at least one of a direction in which the amount of heat dissipated from the top surface by cooling decreases and a direction in which the amount of heat dissipated from the bottom surface by cooling increases as a control direction, and, in a case in which the temperature of the hot-rolled steel sheet is higher than the average temperature, determines at least one of a direction in which the amount of heat dissipated from the top surface by cooling increases and a direction in which the amount of heat dissipated from the bottom surface by cooling decreases as the control direction, in an area with a negative changing speed, in a case in which the temperature of the hot-rolled steel sheet is lower than the average temperature, determines at least one of a direction in which the amount of heat dissipated from the top surface by cooling increases and a direction in which the amount of heat dissipated from the bottom surface by cooling decreases as the control direction, and, in a case in which the temperature of the hot-rolled steel sheet is higher than the average temperature, determines at least one of a direction in which the amount of heat dissipated from the top surface by cooling decreases and a direction in which the amount of heat dissipated from the bottom surface by cooling increases as the control direction; and a total amount of heat dissipated by cooling-adjusting unit that adjusts a total value of the amount of heat dissipated from the top surface by cooling and the amount of heat dissipated from the bottom surface by cooling of the hot-rolled steel sheet in the cooling section based on the control directions determined using the control direction-determining unit.

2. The apparatus for cooling a hot-rolled steel sheet according to claim 1, wherein a location deviation between a temperature measurement place of the thermometer and a shape measurement place of the shape meter on the hot-rolled steel sheet is 50 mm or less.

3. The apparatus for cooling a hot-rolled steel sheet according to claim 2, wherein a sheet-threading speed of the hot-rolled steel sheet in the cooling section is set in a range of 550 m/min to a mechanical limit speed.

4. The apparatus for cooling a hot-rolled steel sheet according to claim 3, wherein a tensile strength of the hot-rolled steel sheet is 800 MPa or more.

5. The apparatus for cooling a hot-rolled steel sheet according to claim 3, wherein the finishing mill is constituted by a plurality of rolling stands, and a supplementary cooling device that carries out supplementary cooling of the hot-rolled steel sheet is further provided between the adjacent rolling stands.

6. The apparatus for cooling a hot-rolled steel sheet according to claim 1, wherein a sheet-threading speed of the hot-rolled steel sheet in the cooling section is set in a range of 550 m/min to a mechanical limit speed.

7. The apparatus for cooling a hot-rolled steel sheet according to claim 6, wherein a tensile strength of the hot-rolled steel sheet is 800 MPa or more.

8. The apparatus for cooling a hot-rolled steel sheet according to claim 6, wherein the finishing mill is constituted by a plurality of rolling stands, and a supplementary cooling device that carries out supplementary cooling of the hot-rolled steel sheet is further provided between the adjacent rolling stands.

* * * * *